US011841660B2

(12) United States Patent
Tanaka et al.

(10) Patent No.: US 11,841,660 B2
(45) Date of Patent: Dec. 12, 2023

(54) IMAGE FORMING APPARATUS

(71) Applicant: CANON KABUSHIKI KAISHA, Tokyo (JP)

(72) Inventors: Sumito Tanaka, Tokyo (JP); Sho Ikemoto, Kanagawa (JP); Tatsuomi Murayama, Chiba (JP); Yuko Kiyota, Ibaraki (JP); Hiroyuki Eda, Ibaraki (JP); Hiromi Shimura, Ibaraki (JP); Yuya Ohta, Chiba (JP); Shin Iwasaki, Chiba (JP); Rumi Konno, Ibaraki (JP); Yuga Yamauchi, Chiba (JP); Riki Fukuhara, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 18/081,888

(22) Filed: Dec. 15, 2022

(65) Prior Publication Data

US 2023/0120867 A1 Apr. 20, 2023

Related U.S. Application Data

(63) Continuation of application No. 17/584,961, filed on Jan. 26, 2022, now Pat. No. 11,567,440.

(30) Foreign Application Priority Data

Jan. 29, 2021 (JP) ..... 2021-013701
Feb. 4, 2021 (JP) ..... 2021-016511

(51) Int. Cl.
*G03G 15/00* (2006.01)
*G03G 15/01* (2006.01)

(52) U.S. Cl.
CPC ..... *G03G 15/5058* (2013.01); *G03G 15/0131* (2013.01); *G03G 15/5041* (2013.01); *G03G 15/5062* (2013.01)

(58) Field of Classification Search
CPC ..... G03G 15/0131; G03G 15/5062; G03G 15/5041; G03G 15/5058
See application file for complete search history.

(56) References Cited

U.S. PATENT DOCUMENTS 6,115,561 A 9/2000 Fukushima
7,385,737 B2 6/2008 Zaima

FOREIGN PATENT DOCUMENTS

JP 2014-107648 A 6/2014

*Primary Examiner* — Hoang X Ngo
(74) *Attorney, Agent, or Firm* — Venable LLP

(57) ABSTRACT

An image forming apparatus includes an image processor configured to convert image data based on a first conversion condition; an image forming unit configured to form an image on a sheet based on the image data converted by the image processor, the image forming unit having an image bearing member on which the image is to be formed, a transfer unit configured to transfer the image from the image bearing member onto the sheet, and a fixing unit configured to fix the image to the sheet; a conveyance roller configured to convey the sheet having the image fixed thereto; a reading unit configured to read a pattern image on the sheet conveyed by the conveyance roller; and a detector configured to detect a pattern image on the image bearing member.

18 Claims, 21 Drawing Sheets

| ITEM | INFORMATION |
|---|---|
| MEDIUM | MEDIUM A |
| CREATION TIME | Y/M/D/H/M |
| NUMBER OF OUTPUT SHEETS | N SHEETS |
| DEVELOPING CONTRAST SETTING | ±0 |
| TRANSFER CURRENT SETTING | ±0 |
| FIXING SETTING | ±0 |
| DITHER | DITHER A |
| SIMPLEX PRINTING/ DUPLEX PRINTING | DUPLEX PRINTING |
| IMAGE DENSITY SENSOR LIGHT AMOUNT | N |
| LINE SENSOR LIGHT AMOUNT | N |

FIG. 12

IMAGE FORMING APPARATUS

BACKGROUND OF THE INVENTION

Field of the Invention

The present disclosure relates to an image forming apparatus such as a copying machine, a multifunction peripheral, or a printer.

Description of the Related Art

A full-color image forming apparatus employing an electrophotographic system performs image formation by forming an image on an image bearing member, transferring the image from the image bearing member onto a recording material, and fixing the transferred image to the recording material. The image to be formed on the recording material changes in image density due to environmental conditions such as temperature and humidity and deterioration of developer used for development. Accordingly, the image forming apparatus forms a test image for adjusting the image density and adjusts image forming conditions or creates a tone correction table based on a result of reading the test image by a sensor, to thereby stabilize the image density. This operation is called "calibration." Calibration includes a case of being performed through use of a reading result of a test image formed on the recording material, and a case of being performed through use of a reading result of a test image on the image bearing member before the test image is transferred onto the recording material.

The image forming apparatus disclosed in Japanese Patent Application Laid-open No. 2014-107648 performs calibration by forming a test image in a margin region on the recording material on which an image (user image) is to be formed in accordance with an instruction from a user. In this manner, the calibration is performed in real time during a print job. The margin region in which the test image is to be formed is a region to be cut at an outer edge of the recording material. Such an image forming apparatus maintains an appropriate image density characteristic (tone characteristic), and also prevents an image forming operation from being interrupted to suppress reduction in productivity.

The image forming apparatus of Japanese Patent Application Laid-open No. 2014-107648 can execute the calibration using the reading result of the test image on the image bearing member in addition to the calibration using the reading result of the test image formed on the recording material. However, when the calibrations of different methods are performed as described above, a target value may vary in each calibration. Further, a correction amount to be determined in the calibration may vary. This variation is caused due to, for example, a difference in the sensor to be used in the calibration or the target value being not always the same in each calibration. As a result, a highly accurate stability of the image density (image quality) may be inhibited.

The present disclosure has been made in view of the above-mentioned problems, and has an object to provide an image forming apparatus capable of forming an image having a stable image quality even when calibration is performed by different methods.

SUMMARY OF THE INVENTION

An image forming apparatus according to the present disclosure includes: an image processor configured to convert image data based on a first conversion condition; an image forming unit configured to form an image on a sheet based on the image data converted by the image processor, the image forming unit having an image bearing member on which the image is to be formed, a transfer unit configured to transfer the image from the image bearing member onto the sheet, and a fixing unit configured to fix the image to the sheet; a conveyance roller configured to convey the sheet having the image fixed thereto; a reading unit configured to read a pattern image on the sheet conveyed by the conveyance roller; a detector configured to detect a pattern image on the image bearing member; and a controller configured to: control the image forming unit to form a first pattern image on a first sheet; control the reading unit to read the first pattern image on the first sheet; control the image forming unit to form a second pattern image on the image bearing member; control the detector to detect the second pattern image on the image bearing member; generate, based on a reading result of the first pattern image by the reading unit and a detection result of the second pattern image by the detector, a second conversion condition for converting the reading result of the first pattern image on the sheet to the detection result of the second pattern image on the image bearing member; control the image forming unit to form a third pattern image on a second sheet; control the reading unit to read the third pattern image on the second sheet; convert a reading result of the third pattern image by the reading unit, based on the second conversion condition; and update the first conversion condition based on the converted reading result of the third pattern image by the reading unit.

Further features of the present invention will become apparent from the following description of exemplary embodiments (with reference to the attached drawings).

BRIEF DESCRIPTION OF THE DRAWINGS

FIG. 12 is an explanatory table of information to be used for determination on regeneration.

DESCRIPTION OF THE EMBODIMENTS

Now, a description is given of embodiments of the present disclosure with reference to the drawings. Various limitations that are technically preferred for embodying the present disclosure are placed on the embodiments to be described below, but are not intended to limit the scope of the disclosure to the following embodiments and illustrated examples.

First Embodiment

Figure 1:
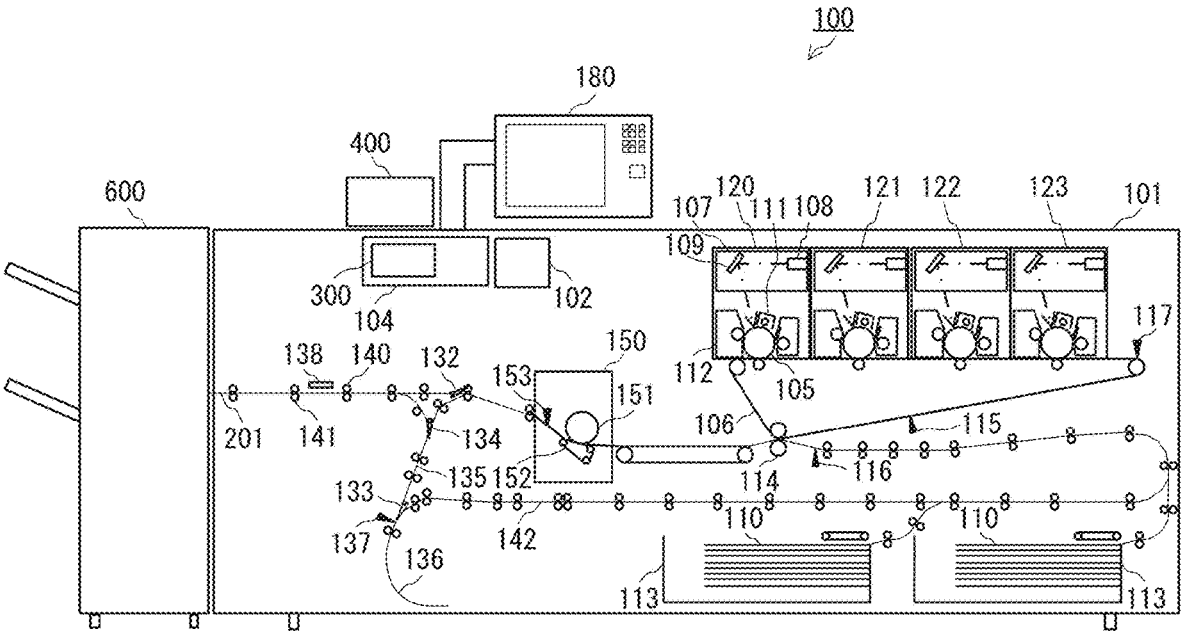
FIG. 1 is a configuration view of an image forming apparatus.

FIG. 1 is a configuration view of an image forming apparatus according to a first embodiment of the present disclosure. An image forming apparatus 100 of the first embodiment is formed of a printer 101, a reader 400, and a finisher 600. The image forming apparatus 100 (printer 101) forms an image on a sheet-shaped recording material 110 by an electrophotographic system. The printer 101 in the first embodiment may be an inkjet printer or a dye-sublimation printer.

The image forming apparatus 100 includes, inside of the printer 101, mechanisms forming an engine unit for performing image formation, an engine control unit 102 for controlling operations of the respective mechanisms, and a control board accommodating unit 104 for accommodating a printer controller 300. An operation panel 180 is provided on an upper portion of the printer 101. The operation panel 180 is a user interface, and includes an input device and an output device. The input device receives instructions from a user. The output device displays an operation screen and other screens. The input device is comprised of various key buttons, a touch panel, and the like. The output device is comprised of a display and a speaker. The reader 400 is an image reading device for reading an image from a recording material (original) having the image formed thereon.

The mechanisms forming the engine unit include a charging/exposure processing mechanism, a development processing mechanism, a transfer processing mechanism, a fixing processing mechanism, a feeding processing mechanism for the recording material 110, and a conveyance processing mechanism for the recording material 110. The charging/exposure processing mechanism scans laser light so as to form an electrostatic latent image. The development processing mechanism visualizes the electrostatic latent image. The transfer processing mechanism transfers a toner image generated through the visualization onto the recording material 110. The fixing processing mechanism fixes the toner image transferred onto the recording material 110.

Those mechanisms are formed of image forming units 120, 121, 122, and 123, an intermediate transfer member 106, a fixing device 150, sheet feeding cassettes 113, and the like which are included in the printer 101. The image forming units 120, 121, 122, and 123 are different from each other only in colors of images to be formed, and have similar configurations to perform similar operations. The image forming unit 120 forms a yellow (Y) image. The image forming unit 121 forms a magenta (M) image. The image forming unit 122 forms a cyan (C) image. The image forming unit 123 forms a black (K) image. Each of the image forming units 120, 121, 122, and 123 includes a photosensitive drum 105, a charging device 111, a laser scanner 107, and a developing device 112.

The charging/exposure processing mechanism uniformly charges the surface of the photosensitive drum 105 by the charging device 111, and forms the electrostatic latent image on the surface of the photosensitive drum 105 by the laser scanner 107. The photosensitive drum 105 is a drum-shaped photosensitive member having a photosensitive layer on its surface, and rotates about a drum shaft. The charging device 111 uniformly charges the photosensitive layer on the surface of the rotating photosensitive drum 105.

The laser scanner 107 includes a light emitter 108 for scanning laser light emitted from a semiconductor laser in one direction and a reflective mirror 109 for reflecting the laser light from the light emitter 108 toward the photosensitive drum 105. The laser scanner 107 includes a laser driver for causing the light emitter 108 to emit laser light in accordance with image data supplied from the printer controller 300. The laser light emitted from the semiconductor laser is oscillated in one direction in accordance with the rotation of a rotary polygon mirror included in the light emitter 108. The laser light oscillated in one direction is irradiated to the photosensitive drum 105 via the reflective mirror 109. In this manner, the laser light scans the surface of the photosensitive drum 105 in one direction (drum shaft direction) so that the electrostatic latent image is formed. The one direction (depth direction of FIG. 1) in which the laser scanner 107 scans the photosensitive drum 105 corresponds to a main scanning direction.

The development processing mechanism visualizes the electrostatic latent image with toner supplied from the developing device 112 so as to form a toner image on the photosensitive drum 105. The toner image on the photosensitive drum 105 is transferred onto the intermediate transfer member 106 applied with a voltage having a characteristic opposite to that of the toner image. At the time of color image formation, toner images are sequentially transferred in superimposition onto the intermediate transfer member 106 from the photosensitive drums 105 of the respective image forming units 120, 121, 122, and 123 corresponding to the respective colors. In the first embodiment, the intermediate transfer member 106 rotates clockwise in FIG. 1, and the toner images are transferred in the order of the image forming unit 120 (yellow), the image forming unit 121 (magenta), the image forming unit 122 (cyan), and the image forming unit 123 (black). In this manner, full-color toner images (visible images) are formed on the intermediate transfer member 106. The photosensitive drum 105 and the developing device 112 can be mounted to or removed from a casing of the printer 101.

The transfer processing mechanism transfers the visible images (toner images) formed on the intermediate transfer member 106 onto the recording material 110 fed from the sheet feeding cassette 113. The transfer processing mechanism includes a transfer roller 114 for transferring the toner images from the intermediate transfer member 106 onto the recording material 110. The toner images transferred from the image forming units 120, 121, 122, and 123 onto the intermediate transfer member 106 are conveyed to the transfer roller 114 by the intermediate transfer member 106 rotating clockwise in FIG. 1. The recording material 110 is conveyed to the transfer roller 114 in synchronization with a timing at which the toner images are conveyed to the transfer roller 114. The transfer roller 114 is applied with a bias having a characteristic opposite to that of the toner images at the same time in a case where the recording material 110 is brought into pressure-contact with the intermediate transfer member 106. Thus, the toner images are transferred onto the recording material 110.

Around the intermediate transfer member 106, an image formation start position detection sensor 115 and an image density sensor 117 are arranged. The image formation start position detection sensor 115 is used for determination on a print start position at the time of image formation. The image formation start position detection sensor 115 is provided on the upstream side of the transfer roller 114 in a rotating direction of the intermediate transfer member 106. The image density sensor 117 is used for measurement of an image density of a test image for image density detection, which is to be formed on the intermediate transfer member 106, at the time of image density control. The image density sensor 117 is provided on the downstream side of the image forming unit 123 in the rotating direction of the intermediate transfer member 106.

The feeding processing mechanism includes the sheet feeding cassettes 113 each of which stores the recording material 110, a conveyance path through which the recording material 110 is to be fed, and various rollers for conveying the recording material 110. The recording material 110 is fed from the sheet feeding cassette 113, and while being conveyed through the conveyance path, has a toner image transferred thereonto and fixed thereto. Thus, the image is formed on the recording material 110, and then the recording material 110 is discharged to the outside of the printer 101. A conveying direction of the recording material 110 corresponds to a sub-scanning direction orthogonal to the main scanning direction.

The recording material 110 is fed from the sheet feeding cassette 113, and conveyed to the transfer roller 114 through the conveyance path. A sheet feeding timing sensor 116 for adjusting a conveyance timing of the recording material 110 is provided midway through the conveyance path from the sheet feeding cassette 113 to the transfer roller 114. A timing at which the recording material 110 is conveyed to the transfer roller 114 is adjusted based on a timing at which the image formation start position detection sensor 115 detects the image on the intermediate transfer member 106 and a timing at which the sheet feeding timing sensor 116 detects the recording material 110. Through this adjustment, the toner image is transferred from the intermediate transfer member 106 onto the recording material 110 at a predetermined position.

The recording material 110 onto which the toner image has been transferred is conveyed to the fixing processing mechanism. The fixing processing mechanism in the first embodiment includes the fixing device 150. In order to thermally compress the toner image on the recording material 110, the fixing device 150 includes a fixing roller 151 for heating the recording material 110, a pressure belt 152 for bringing the recording material 110 into pressure contact with the fixing roller 151, and a post-fixing sensor 153 for detecting completion of fixing. The fixing roller 151, which is a hollow roller, includes a heater inside, and is configured to convey the recording material 110 by rotating. The pressure belt 152 brings the recording material 110 into pressure contact with the fixing roller 151. The post-fixing sensor 153 detects the recording material 110 after the image fixing.

The recording material 110 subjected to the image fixing by the fixing device 150 may be discharged as it is or may be conveyed to a conveyance path 135. Accordingly, a flapper 132 is provided after the fixing device 150. The flapper 132 guides the recording material 110 to any one of the conveyance path 135 and a conveyance path 201. The conveyance path 201 includes conveyance rollers 140 and 141. The recording material 110 guided to the conveyance path 201 is conveyed by the conveyance rollers 140 and 141 so as to be discharged from the printer 101 to the finisher 600 with its surface having the image formed thereon facing upward. Between the conveyance roller 140 and the conveyance roller 141 of the conveyance path 201, a line sensor 138 is provided at a position at which the image of the recording material 110 can be detected.

The line sensor 138 is an optical sensor such as a CMOS line sensor or a CCD line sensor. The line sensor 138 reads the image formed on the recording material 110 conveyed through the conveyance path 201 by the conveyance rollers 140 and 141. The line sensor 138 outputs, as a reading result, a reading signal including luminance values of respective colors of red (R), green (G), and blue (B). Those luminance values of the reading signal are converted into density values of the respective colors of cyan (C), magenta (M), yellow (Y), and black (K) so as to be used. In general, cyan is calculated from a luminance value of a red sensor, magenta is calculated from a luminance value of a green sensor, yellow is calculated from a luminance value of a blue sensor, and black is calculated from a luminance value of a green sensor. At this time, a look-up table (LUT) generated by acquiring in advance the relationship between the luminance values of RGB and the density values of CMYK is used so that conversion from the luminance values to the density values of the respective colors is performed. Such an LUT is stored in advance in the image forming apparatus 100.

The conveyance path 135 is a path for conveying the recording material 110 to a reverse portion 136 to be used for reversing the front and back surfaces of the recording material 110. A sheet surface reverse sensor 137 for detecting the recording material 110 is provided on the reverse portion 136. In a case where the sheet surface reverse sensor 137 detects the trailing edge of the recording material 110, the recording material 110 has the conveying direction reversed on the reverse portion 136. The recording material 110 having the conveying direction reversed is conveyed to any one of the conveyance path 135 and a reverse path 142. Therefore, a flapper 133 is provided at a branch point between the conveyance path 135 and the reverse path 142. In the case of being conveyed to the conveyance path 135, the recording material 110 is guided to the conveyance path 135 by the flapper 133, and is further guided to the conveyance path 201 by a flapper 134. Thus, the recording material 110 is discharged from the printer 101 to the finisher 600 with the front and back surfaces of the recording material 110 being reversed (with the surface on which the image has been formed facing downward). In the case of being conveyed to the reverse path 142, the recording material 110 is guided to the reverse path 142 by the flapper 133. The recording material 110 which has been guided to the reverse path 142 has the front and back surfaces reversed to be conveyed to the transfer roller 114 again. Thus, an image is formed on the back surface of the recording material 110.

<Image Density Sensor>

Figure 2:
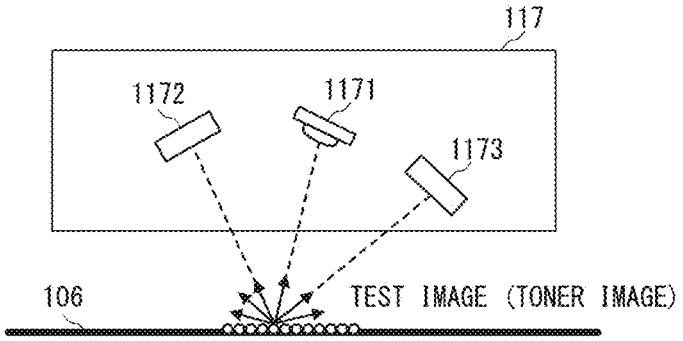
FIG. 2 is a configuration explanatory view of an image density sensor.

FIG. 2 is a configuration explanatory view of the image density sensor 117. As described above, the image density sensor 117 detects the test image for image density detection, which has been formed on the intermediate transfer member 106. The image density sensor 117 includes an optical sensor and an electric circuit board (not shown). The optical sensor includes a light emitting diode (LED) 1171 serving as a light source and light receivers 1172 and 1173. The optical sensor is mounted on the electric circuit board. The light receivers 1172 and 1173 are, for example, photodiodes.

The LED 1171 irradiates infrared light to the intermediate transfer member 106 at a predetermined incident angle (in this case, 15°). The light receiver 1172 receives, at a specular reflection angle position, reflection light of light emitted from the LED 1171, which has been irradiated to the intermediate transfer member 106 and the test image. The light receiver 1173 receives diffuse reflection light of the reflection light of the light emitted from the LED 1171, which has been irradiated to the intermediate transfer member 106 and the test image. On the electric circuit board, a drive circuit and a light receiving circuit are mounted. The drive circuit supplies a current to the LED 1171 to cause the LED 1171 to emit light. The light receiving circuit has an IV conversion function of converting, into a voltage, a current generated in accordance with a light receiving amount of the reflection light received by the light receivers 1172 and 1173.

The image density sensor 117 having the above-mentioned configuration can measure both of specular reflection light and diffuse reflection light. The light receiver 1172 for receiving the specular reflection light and the light receiver 1173 for receiving the diffuse reflection light each measure the reflection light reflected by the intermediate transfer member 106 and the reflection light reflected by the test image.

At this time, the test image made of black toner is converted into a density value from a detection result of the specular reflection light acquired by the light receiver 1172. The test images made of chromatic colors of cyan, magenta, and yellow are converted into density values from detection results of the diffuse reflection light acquired by the light receiver 1173. As described above, the image forming apparatus 100 converts a luminance value included in the detection result into a density value through use of the LUT.

The configuration of the image density sensor 117 is not limited to the configuration described in the first embodiment. For example, the light receiver 1172 or the light receiver 1173 may be arranged so that an optical axis in which the reflection light is received is directed in a normal direction with respect to a surface of the intermediate transfer member 106 on which the test image is to be formed. Further, the light receiver 1172 and the light receiver 1173 may have a configuration including a polarizing filter. In the first embodiment, there is described a configuration in which the light receiver 1172 and the light receiver 1173 are arranged at positions opposed to a position at which the infrared light irradiated from the LED 1171 is reflected by the intermediate transfer member 106, but the light receiver 1172 and the light receiver 1173 can be arranged as appropriate.

<Printer Controller>

Figure 3:
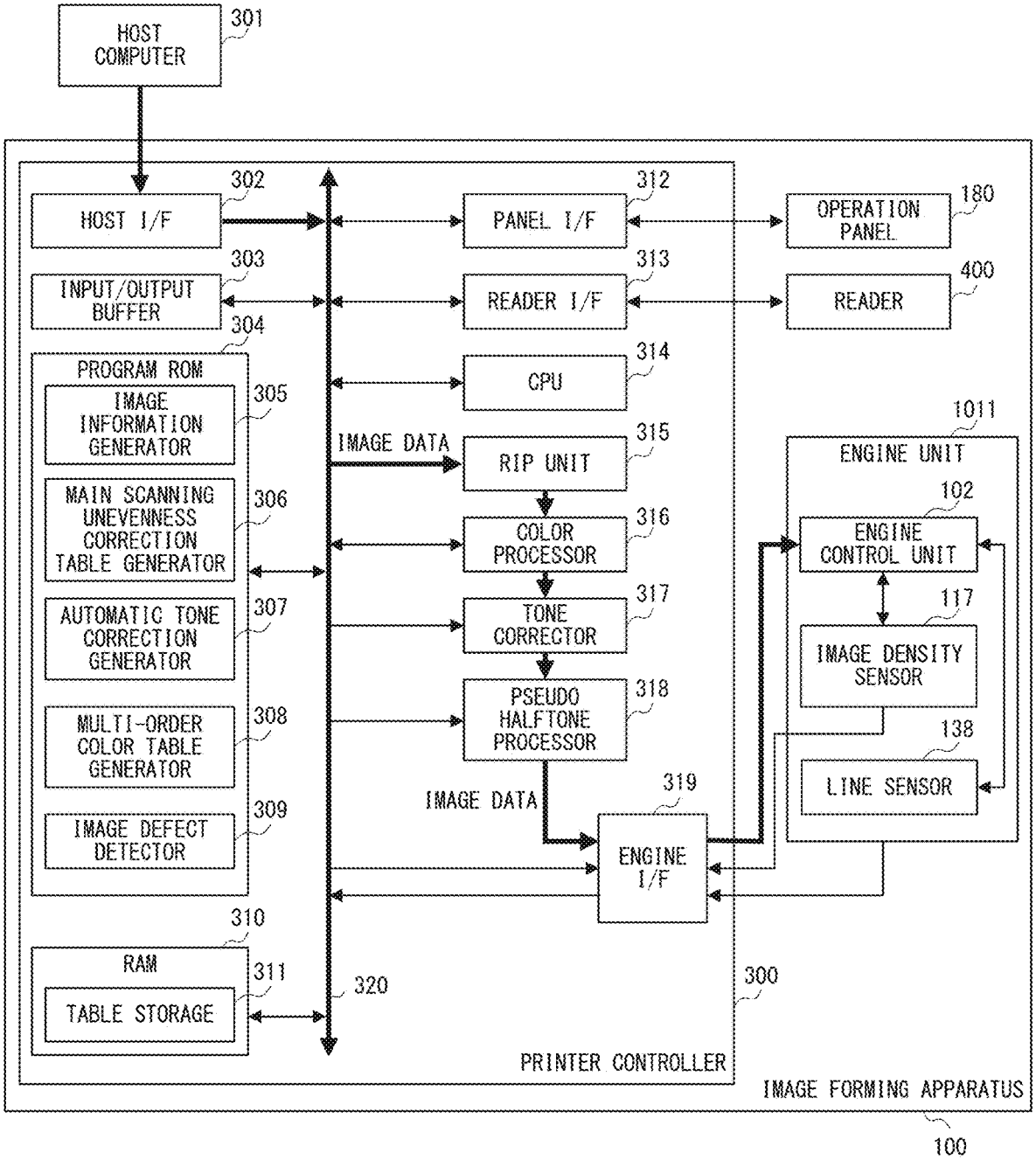
FIG. 3 is an explanatory diagram of a printer controller.

FIG. 3 is an explanatory diagram of the printer controller 300 in the first embodiment. The printer controller 300 is connected to a host computer 301 being an apparatus provided outside of the image forming apparatus 100 so as to allow communication to/from the host computer 301. The host computer 301 and the image forming apparatus 100 are connected so as to allow communication therebetween wirelessly or through communication lines such as USB 2.0 High-Speed and 1000Base-T/100Base-TX/10Base-T (following IEEE 802.3).

The printer controller 300 controls the operation of the entire printer 101. Accordingly, the printer controller 300 is connected to the operation panel 180, the reader 400, and an engine unit 1011. The engine unit 1011 controls operations of the respective mechanisms included in the printer 101 in accordance with the instruction from the printer controller 300, to thereby perform image formation processing to the recording material 110. The engine unit 1011 includes the engine control unit 102. The engine control unit 102 controls the operations of the respective mechanisms of the engine unit 1011. The engine control unit 102 also controls an operation of detecting the test image to be performed by the image density sensor 117 and the line sensor 138. The engine control unit 102 is formed of, for example, a central processing unit (CPU).

The printer controller 300 includes a host interface (I/F) 302, a panel interface (I/F) 312, a reader interface (I/F) 313, an engine interface (I/F) 319, and an input/output buffer 303. The host I/F 302 is a communication interface with respect to the host computer 301. The panel I/F 312 is an interface with respect to the operation panel 180. The reader I/F 313 is a communication interface with respect to the reader 400. The engine IF 319 is a communication interface with respect to the engine unit 1011. The input/output buffer 303 is a temporary storage area for transmitting and receiving control codes and data via each interface.

The printer controller 300 includes a CPU 314, a program read only memory (ROM) 304, and a random access memory (RAM) 310. The CPU 314 executes a computer program stored in the program ROM 304, to thereby control the operation of the printer controller 300. The RAM 310 provides a work area to be used in a case where the printer controller 300 executes the processing.

The program ROM 304 includes, as modules, an image information generator 305, a main scanning unevenness correction table generator 306, an automatic tone correction generator 307, a multi-order color table generator 308, and an image defect detector 309. The image information generator 305 generates various image objects based on settings of data acquired from the host computer 301. The main scanning unevenness correction table generator 306 generates a main scanning unevenness correction table for suppressing the image density unevenness in the main scanning direction by correcting laser light emission intensity. The automatic tone correction generator 307 generates a tone correction table (γLUT) for performing density tone correction of a single color. The multi-order color table generator 308 generates an ICC profile being a multi-dimensional LUT in order to correct variations in multi-order color. The image defect detector 309 detects an image defect in the image read by the line sensor 138.

The RAM 310 temporarily stores processing results obtained by the image information generator 305, the main scanning unevenness correction table generator 306, the automatic tone correction generator 307, and the multi-order color table generator 308. The RAM 310 includes a table storage 311. The table storage 311 stores the main scanning unevenness correction table, the γLUT, the ICC profile, and a density conversion table to be described later.

The printer controller 300 includes a raster image processor (RIP) unit 315, a color processor 316, a tone corrector 317, and a pseudo halftone processor 318. The RIP unit 315 expands the image object (image data) into a bitmap image. The color processor 316 subjects the image data expanded into the bitmap image by the RIP unit 315 to color conversion processing of a multi-order color through use of the ICC profile. The tone corrector 317 subjects the image data subjected to the color conversion processing by the color processor 316 to tone correction processing of a single color through use of the γLUT. The pseudo halftone processor 318 subjects the image data subjected to the tone correction by the tone corrector 317 to pseudo halftone processing such as dither matrix or an error diffusion method. The image data subjected to the pseudo halftone processing by the pseudo halftone processor 318 is transmitted to the engine unit 1011 via the engine I/F 319. The engine control unit 102 of the engine unit 1011 performs the image formation processing based on the image data acquired from the engine I/F 319.

Each unit of the printer controller 300 described above is connected to a system bus 320, and can perform communication via the system bus 320. The CPU 314 manages and updates the ICC profile, the γLUT, and the main scanning unevenness correction table to be used at the time of image formation, via the system bus 320. The CPU 314 causes the color processor 316, the tone corrector 317, or the like to reflect the latest table so that an image of a desired color can be output.

<γLUT>

Figure 4:
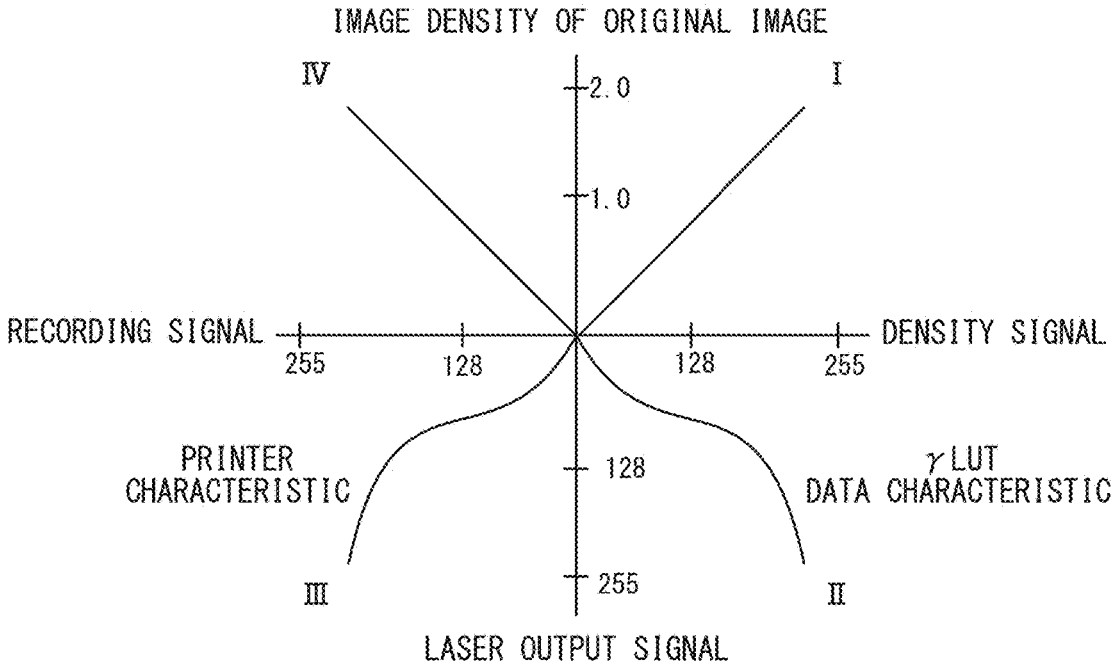
FIG. 4 is a four-quadrant chart for illustrating a state in which a tone is reproduced.

The γLUT independent of a location at which the test image for tone correction is formed is described. FIG. 4 is a four-quadrant chart for illustrating a state in which a tone is reproduced. Quadrant I represents a reading characteristic of a sensor which has read an original image. This sensor converts an image density of the original image into a density signal. Quadrant II represents a conversion characteristic (data characteristic) of the γLUT, for converting the density signal into a laser output signal representing a light amount of laser light to be output from the laser scanner 107. Quadrant III represents a recording characteristic of the printer 101 for converting the laser output signal into an image density of an image to be formed on the recording material. Quadrant IV represents a relationship between the image density of the original image and the image density of the image formed on the recording material. That is, the four-quadrant chart represents a total tone reproducing characteristic of the image forming apparatus 100 illustrated in FIG. 1.

FIG. 4 shows a case in which the processing is performed with 8-bit digital signals, and the number of tone levels is 256. In this case, the sensor in Quadrant I is the line sensor 138 for reading the test image for tone correction on the recording material 110, or the image density sensor 117 for reading the test image for tone correction on the intermediate transfer member 106. In order to obtain a linear total tone characteristic of the printer 101, that is, a linear tone characteristic of Quadrant IV, a non-linear part of the printer characteristic of Quadrant III is corrected by the γLUT of Quadrant II. The image signal whose tone characteristic is converted by the γLUT is converted into a pulse signal corresponding to a dot width by a pulse width modulation (PWM) circuit of the laser driver, and is transmitted to the laser driver for controlling the drive of the light emitter 108. In the first embodiment, the tone reproducing method employing pulse width modulation is used for all colors of yellow, magenta, cyan, and black.

Through scanning of the laser light output from the light emitter 108 of the laser scanner 107, on the photosensitive drum 105, an electrostatic latent image having a predetermined tone characteristic whose tone is controlled by changing the dot area is formed. This electrostatic latent image is developed as a toner image, and the toner image is transferred and fixed to the recording material 110 so that the tone image is reproduced.

<Tone Correction Using Test Image for Tone Correction Formed on Intermediate Transfer Member 106>

The image forming apparatus 100 performs calibration by two different methods. That is, the image forming apparatus 100 performs calibration using a reading result of the test image printed on an end portion region (non-image region) of the recording material 110, and calibration using a reading result of the test image formed on the intermediate transfer member 106. Those calibrations have been performed in the related art.

The tone correction processing (calibration) to be performed by forming the test image for tone correction on the intermediate transfer member 106 is performed through cooperation between the CPU 314 and the engine control unit 102 for controlling the image density sensor 117. The tone corrector 317 adjusts the tone characteristic of the image to be formed by the printer 101. The tone corrector 317 performs, after the color processor 316 performs initial adjustment of the color correction processing, calibration at an interval of a certain number of sheets (for example, 100 sheets) processed by the printer 101.

Figure 5:
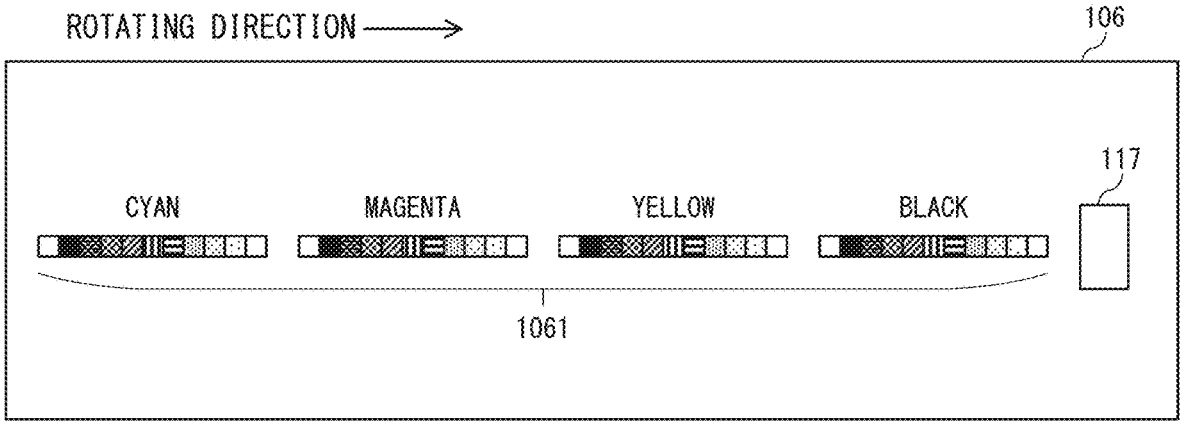
FIG. 5 is an exemplary view of a test image for tone correction.

FIG. 5 is an exemplary view of the test image for tone correction to be formed on the intermediate transfer member 106. The test image for tone correction (tone correction pattern 1061) to be formed on the intermediate transfer member 106 is formed at a position passing through a detection position of the image density sensor 117 through rotation of the intermediate transfer member 106. The tone correction pattern 1061 is formed of, for each color, a plurality of tone patches (in FIG. 5, eleven tone levels) having different tone values step by step. The plurality of tone patches each have, for example, a square shape with one side of about 10 mm, and are arrayed in one row in the rotating direction of the intermediate transfer member 106.

In the tone patches of each color, tone patches for detecting the formation of the intermediate transfer member 106 (that is, tone patches having a tone value of 0) are arranged at both ends in the rotating direction of the intermediate transfer member 106. Between the tone patches having the tone value of 0, nine tone patches whose tone values are equally distributed are arranged. In a case where the tone values are represented by 0 to 255, the tone correction pattern 1061 is formed of tone patches of each color having the tone values of 0, 16, 32, 64, 86, 104, 128, 176, 224, 255, and 0. When a plurality of image density sensors 117 are provided in the main scanning direction (direction orthogonal to the rotating direction of the intermediate transfer member 106), a plurality of tone correction patterns 1061 may be formed so as to correspond to the respective image density sensors 117.

The tone correction pattern 1061 is formed at a timing at which the image forming apparatus 100 does not perform image formation. The tone correction pattern 1061 is formed by interrupting a print job at a timing at which the image forming apparatus 100 has formed images on a predetermined number of recording materials 110, or after the print job is ended. That is, by interrupting the print job at the timing at which the image forming apparatus 100 has formed images on a predetermined number of recording materials 110, or after the print job is ended, the calibration using the reading result of the test image formed on the intermediate transfer member 106 is performed.

A method of updating the γLUT based on the density value read from the tone correction pattern 1061 on the intermediate transfer member 106 is described.

In a case where the image to be formed on the recording material 110 has a target tone reproducing characteristic as immediately after automatic tone correction processing is executed, the value of the tone correction pattern 1061 read by the image density sensor 117 is held as a tone target on the intermediate transfer member 106. The automatic tone correction processing refers to not the tone correction processing to be executed during the print job but the tone correction processing to be performed by the user at a predetermined timing. In the automatic tone correction processing, the maximum density of each color and the tone characteristic in each color and each screen pattern are adjusted to predetermined target values. A conversion LUT for the intermediate transfer member 106, which has been created by comparing the tone target and the density value read from the tone correction pattern 1061, is combined with the YLUT for the recording material 110. In this case, "combine" refers to associating the relationship between the γLUT for the recording material 110 and the tone target of the intermediate transfer member 106 at the time when the target tone reproducing characteristic is obtained on the recording material 110, to thereby create the γLUT for the recording material 110. The γLUT for the recording material 110 is created from the density value of the tone correction pattern 1061 on the intermediate transfer member 106.

<Test Image for Tone Correction Formed on Recording Material 110>

Figure 6:
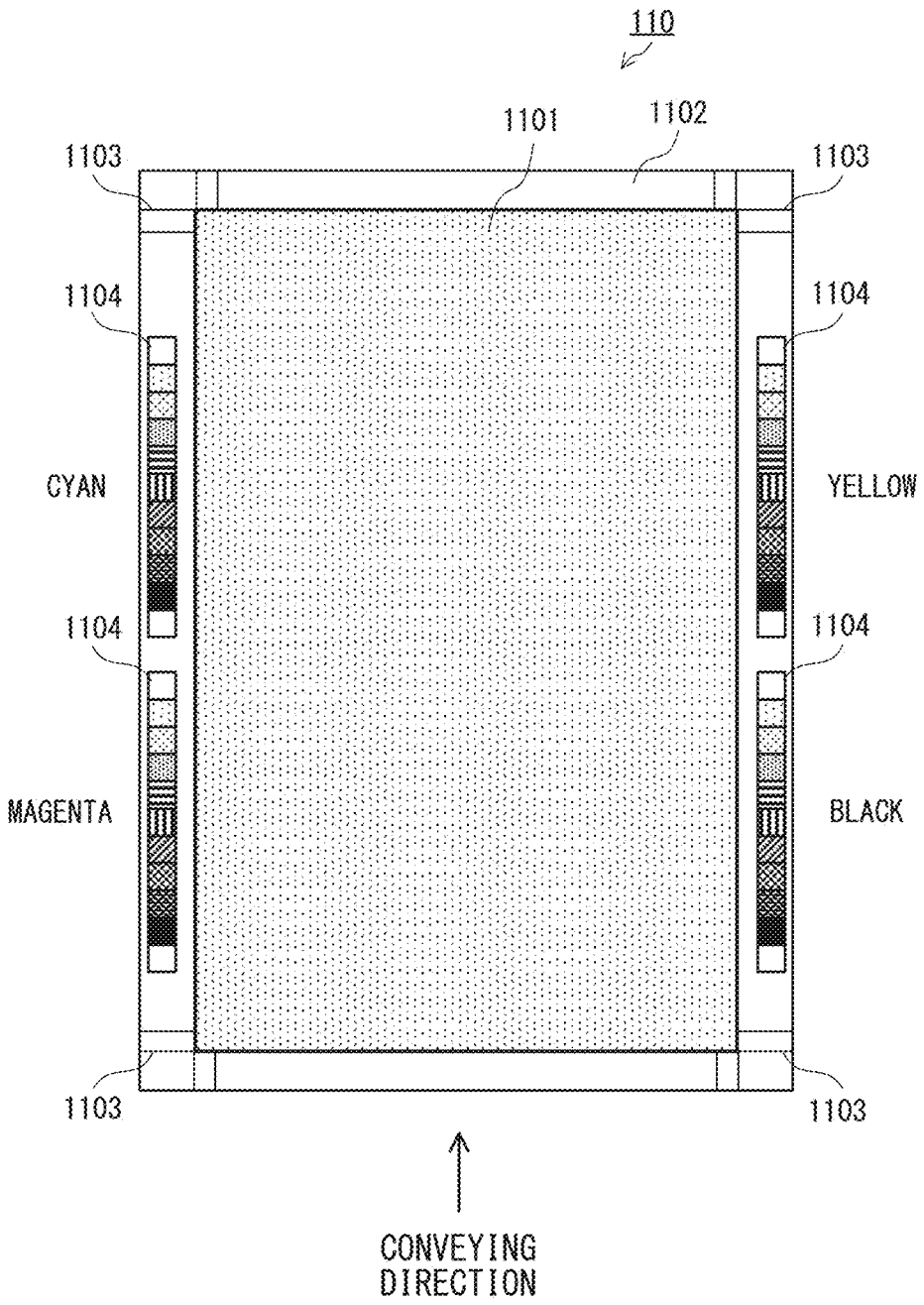
FIG. 6 is an exemplary view of a test image for tone correction.

FIG. 6 is an exemplary view of a test image for tone correction to be formed on the recording material 110 together with a user image formed in accordance with an instruction from the user. The recording material 110 is conveyed in the arrow direction (conveying direction) of FIG. 6. The test image for tone correction (tone correction pattern 1104) to be formed on the recording material 110 is formed in an end portion region (non-image region 1102) of the recording material 110 excluding an image region 1101 on which the user image is to be formed. The tone correction pattern 1104 in the first embodiment is formed in the end portion region (non-image region 1102) of the recording material 110 along the conveying direction. The image region 1101 is a region indicated by dots in FIG. 6. Cutting marks 1103 are marked on the recording material 110 in advance. The cutting mark 1103 is formed by combining two L-shaped marks, and is provided at each of four corners of the image region 1101. The recording material 110 is to be cut along the cutting marks 1103. The dots of the image region 1101 are only shown for description, and no dots are actually printed on the recording material 110.

The tone correction pattern 1104 is formed for each color on one surface of the recording material 110. The tone correction pattern 104 is normally formed in the non-image region 1102 on the outer side of the image region 1101 so as not to overlap the image region 1101. However, in a case where the CPU 314 determines to form the tone correction pattern 1104 so as to overlap the image region 1101, the tone correction pattern 1104 may be formed so as to overlap the image region 1101. In the first embodiment, overlapping the image region 1101 includes not only a case in which the tone correction pattern 1104 is formed so as to overlap only the image region 1101 but also a case in which the tone correction pattern 1104 is formed across the image region 1101 and the non-image region 1102.

The tone correction pattern 1104 may be formed in any of peripheral edge portions of the recording material 110. In the first embodiment, the tone correction pattern 1104 is formed in each of both end portions of the recording material 110 in a direction (transverse direction of the recording material 110) orthogonal to the conveying direction of the recording material 110 (longitudinal direction of the recording material 110). That is, the tone correction patterns 1104 for two colors are formed in one end portion of the recording material 110 in the transverse direction, and the tone correction patterns 1104 for the remaining two colors are formed in another end portion of the recording material 110 in the transverse direction. In the first embodiment, the tone correction patterns 1104 for cyan and magenta are formed in the one end portion of the recording material 110 in the transverse direction, and the tone correction patterns 1104 for yellow and black are formed in the other end portion of the recording material 110 in the transverse direction. Thus, no tone correction pattern 1104 is formed at a leading end portion of the recording material 110 in the conveying direction, and hence occurrence of winding of the recording material 110 at the time of fixing processing can be suppressed more reliably.

The tone correction pattern 1104 is formed of a plurality of tone patches (eleven tone levels in FIG. 6) having different tone values of each color step by step. The plurality of tone patches each have, for example, a square shape with one side of about 8 mm, and are arrayed in one row in the conveying direction.

In the tone patches of each color, tone patches for detecting the formation of the recording material 110 (that is, tone patches having a tone value of 0) are arranged at both ends in the conveying direction of the recording material 110. Between the tone patches having the tone value of 0, nine tone patches whose tone values are equally distributed are arranged. In a case where the tone values are represented by 0 to 255, the tone correction pattern 1104 is formed of tone patches of each color having the tone values of 0, 16, 32, 64, 86, 104, 128, 176, 224, 255, and 0. The colors of the tone correction patterns 1104 are not limited to yellow, magenta, cyan, and black, and the tone correction patterns 1104 may be formed in colors of red, green, and blue and process black. Further, the size and the tone order of the tone correction pattern 1104 are also not limited.

<Density Conversion Table>

A target tone of the recording material 110 and a target tone of an image bearing member like the intermediate transfer member 106 do not have the same target value because measurement locations are different. Accordingly, in a case where the calibration is executed through use of the test image formed on the image bearing member (intermediate transfer member 106) after the calibration is executed through use of the recording material 110, the image density of the image to be formed on the recording material 110 may change. The reason is because the change of the image density of the test image on the recording material 110 and the change of the image density of the test image on the image bearing member are not the same.

The image forming apparatus 100 of the first embodiment uses the target tone of the image bearing member as the target tone of the calibration using the recording material 110. Accordingly, the image forming apparatus 100 requires a density conversion table as a conversion condition for replacing the image density of the image on the recording material 110 with the image density of the image on the image bearing member. With this density conversion table, the image density of the image on the recording material 110 can be regarded as the image density of the image detected on the image bearing member. As a result, the target tone is not required to be set for each recording material 110, and the target tone of the image bearing member can be used.

Figure 7:
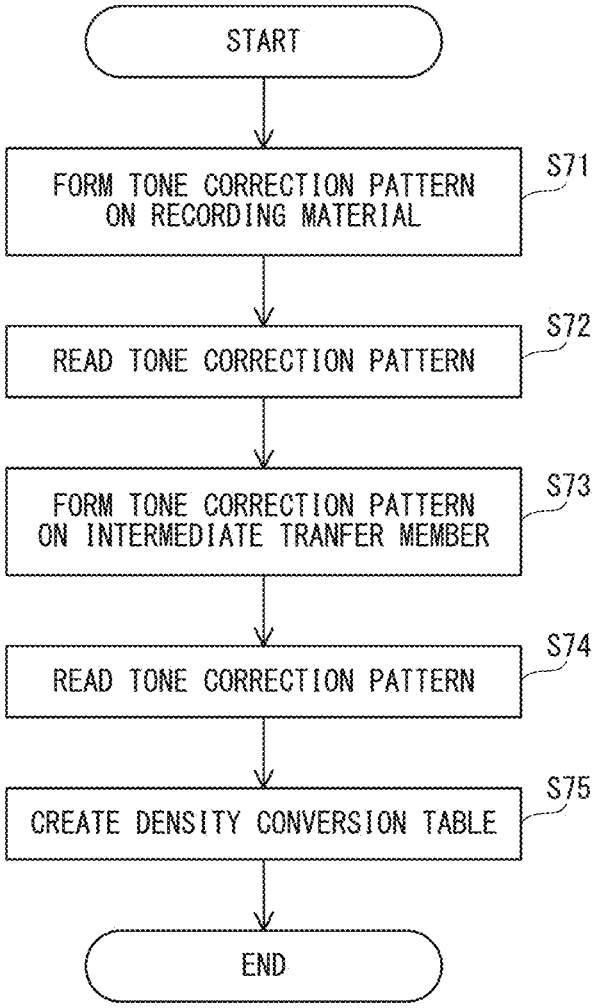
FIG. 7 is a flow chart for illustrating processing of creating a density conversion table.

FIG. 7 is a flow chart for illustrating processing of creating the density conversion table. The density conversion table is created (generated) as follows. The tone correction pattern (pattern image) is formed on each of the intermediate transfer member 106 and the recording material 110, and the density conversion table is created (generated) based on a relationship between reading results of the respective tone correction patterns. It is suitable to create the density conversion table at a timing at which a corresponding type of recording material is first subjected to image formation and output by the image forming apparatus 100. The density conversion table is a look-up table to be created and stored for each type of recording material.

With the density conversion table, the image density on the image bearing member and the image density of the corresponding type of recording material are associated with each other. The density conversion table is obtained by associating the image density of the image of the recording material 110 and the image density of the image of the image bearing member. Thus, an execution timing of the association may be separately determined, and a button for allowing the user to give an instruction of the execution may be prepared. It is suitable to regenerate the density conversion table depending on various conditions. Thus, the density conversion table is regenerated at an appropriate timing based on regeneration determination to be described later.

When the processing of creating the density conversion table is started, the CPU 314 causes the engine control unit 102 to control the engine unit 1011 so as to form, on the recording material 110, the tone correction pattern 1104 (first pattern image) exemplified in FIG. 6 (Step S71). The CPU 314 causes the engine control unit 102 to control the line sensor 138 so as to read the tone correction pattern 1104 formed on the recording material 110 (Step S72). A reading result (sensor signal value) of the tone correction pattern 1104 obtained by the line sensor 138 is transmitted to the CPU 314 via the engine I/F 319. The CPU 314 converts a luminance value included in the sensor signal value into a density value.

The CPU 314 causes the engine control unit 102 to control the engine unit 1011 so as to form, on the intermediate transfer member 106, the tone correction pattern 1061 (second pattern image) exemplified in FIG. 5 (Step S73). The CPU 314 causes the engine control unit 102 to control the image density sensor 117 so as to read the tone correction pattern 1061 formed on the intermediate transfer member 106 (Step S74). A reading result (sensor signal value) of the tone correction pattern 1061 obtained by the image density sensor 117 is transmitted to the CPU 314 via the engine I/F 319. The CPU 314 converts a luminance value included in the sensor signal value into a density value.

The CPU 314 creates a density conversion table based on the relationship between the density value obtained from the reading result of the tone correction pattern 1104 and the density value obtained from the reading result of the tone correction pattern 1061 (Step S75). It is assumed that the tone patches of the tone correction pattern 1104 and the tone patches of the tone correction pattern 1061 have the same tone values, but the present disclosure is not required to be limited thereto. In a case where the tone patches of the tone correction pattern 1104 and the tone patches of the tone correction pattern 1061 have different tone values, the density conversion table is created by subjecting the density values obtained from the respective reading results to linear interpolation and associating the density values subjected to the linear interpolation with each other.

The image forming apparatus 100 of the first embodiment uses the test images for tone correction (tone correction patterns 1104 and 1061) in order to generate the density conversion table. The present disclosure is not limited thereto, and the test image for tone correction and an image (pattern image) for generating the density conversion table may be different images. The image (pattern image) for generating the density conversion table may be, for example, an image having the number of tone levels smaller than that of the test image for tone correction. Further, the image forming apparatus 100 of the first embodiment separately forms the tone correction pattern 1104 and the tone correction pattern 1061 in order to generate the density conversion table, but the pattern image of one type may be detected by the image density sensor 117 and the line sensor 138. In this case, after the pattern image formed on the intermediate transfer member 106 is transferred onto the recording material 110, the line sensor 138 reads the pattern image on the recording material 110. Then, the density conversion table is generated based on a detection result obtained by the line sensor 138 and a detection result obtained by the image density sensor 117.

Figure 8:
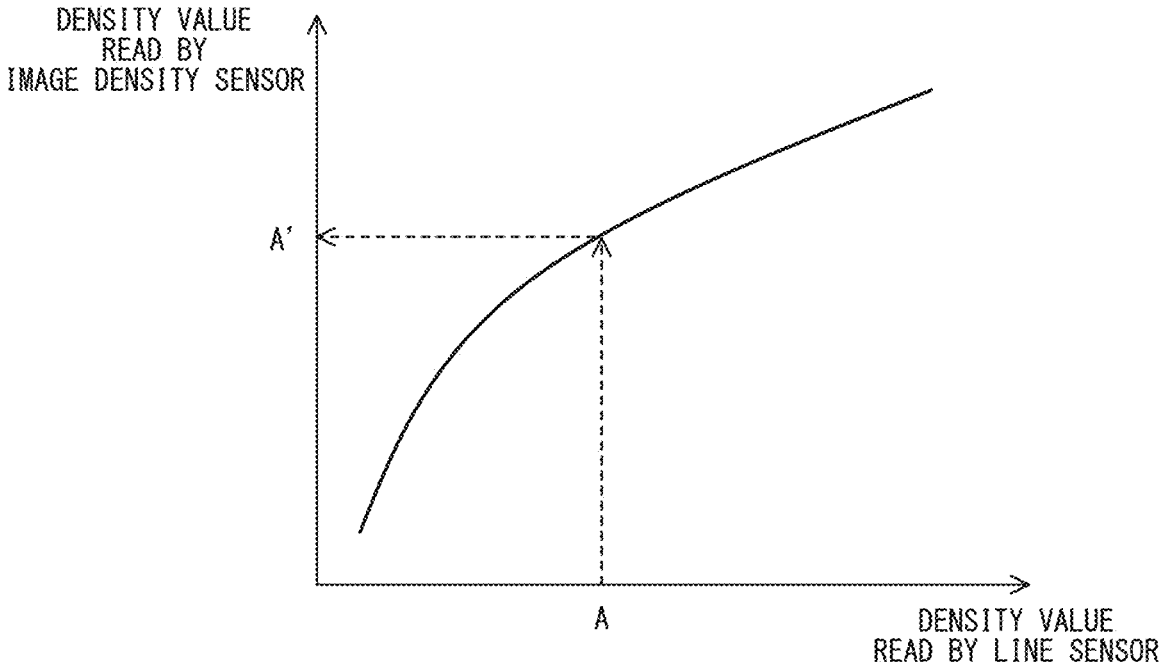
FIG. 8 is an explanatory graph of the density conversion table.

FIG. 8 is an explanatory graph of the density conversion table. The density conversion table indicates the relationship (conversion condition) between the reading result (density value) of the tone correction pattern 1061 on the intermediate transfer member 106, which is obtained by the image density sensor 117, and the reading result (density value) of the tone correction pattern 1104 on the recording material 110, which is obtained by the line sensor 138. The created density conversion table is stored in the table storage 311. A density value A obtained by reading a predetermined image by the line sensor 138 is caused to pass through the density conversion table so as to be converted into a density value A' being a reading result obtained by the image density sensor 117.

<Tone Correction Processing>

The image forming apparatus 100 uses the recording material 110 to execute calibration, for example, tone correction processing, for each page. The tone correction processing using the intermediate transfer member 106 is as described above. The characteristic part of the present disclosure resides in the tone correction processing which is performed in real time through use of the recording material 110.

The tone correction processing to be performed by forming the tone correction pattern 1104 (image for detection) on the recording material 110 is performed through cooperation between the CPU 314 and the engine control unit 102 for controlling the line sensor 138. The tone corrector 317 adjusts the tone characteristic for each recording material 110 on which an image is to be formed by the printer 101. That is, the tone corrector 317 performs calibration every time one recording material 110 is fed. As exemplified in FIG. 6, the tone correction pattern 1104 of the recording material 110 is formed in the non-image region 1102 of the recording material 110. Accordingly, tone correction can be executed for each recording material 110.

Figure 9:
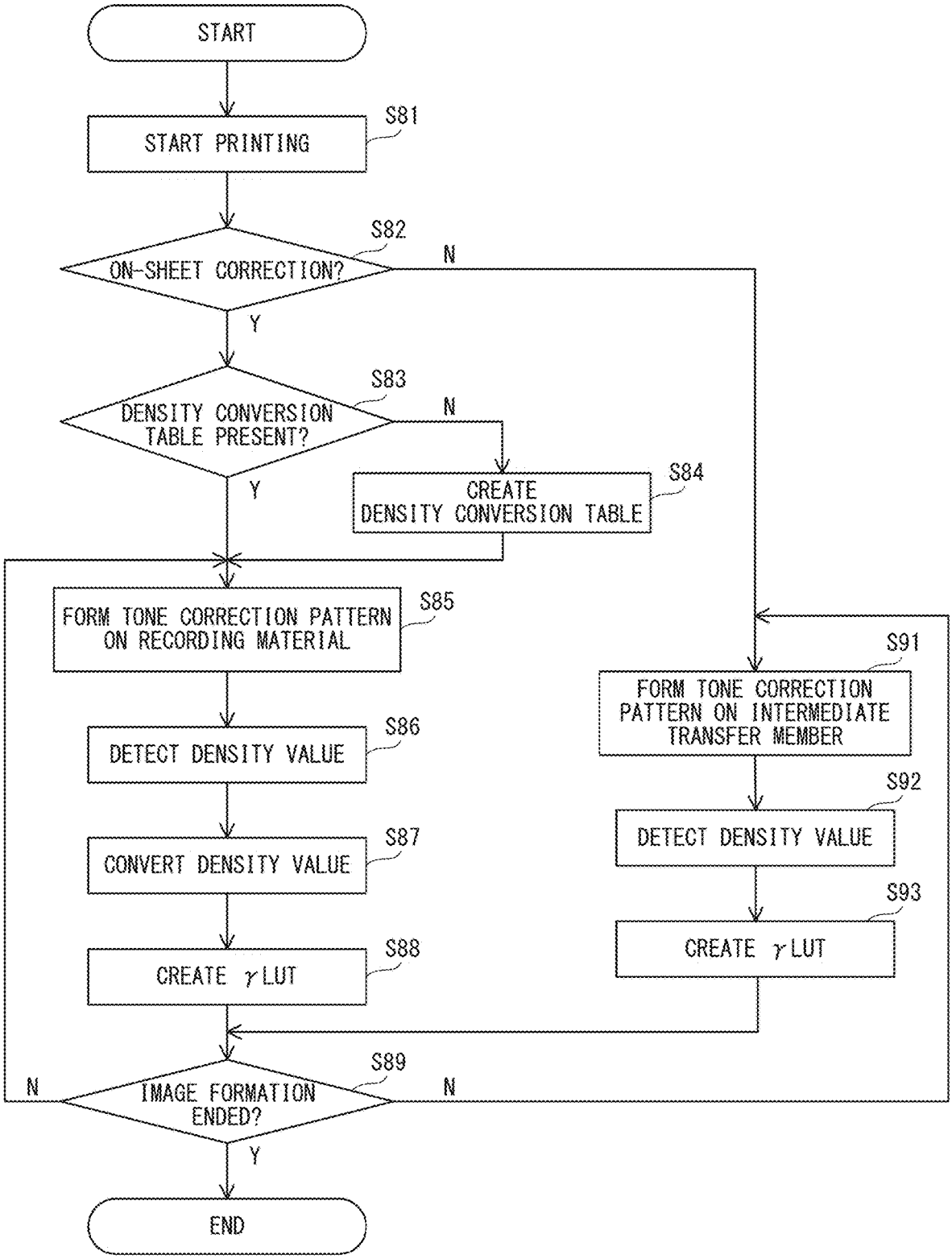
FIG. 9 is a flow chart for illustrating tone correction processing.

FIG. 9 is a flow chart for illustrating the tone correction processing. This tone correction processing is performed for each recording material 110 while an image is formed on the recording material 110 in accordance with the print job.

When the CPU 314 starts printing in accordance with the print job (Step S81), the CPU 314 determines whether or not the user gives an instruction of tone correction using the recording material 110 (on-sheet correction) (Step S82).

In a case where no instruction of on-sheet correction is given (Step S82: N), the CPU 314 sets the tone correction using the intermediate transfer member 106 (image bearing member). The CPU 314 causes the engine control unit 102 to control the engine unit 1011 at a predetermined timing so as to form the tone correction pattern 1061 on the intermediate transfer member 106 (Step S91). The tone correction pattern 1061 is formed at an interval of, for example, twenty recording materials 110 having the user image formed thereon. In a case where a plurality of recording materials 110 are formed of the images, the tone correction pattern 1061 is formed between an N-th image and an (N+1)th image. At this time, N is a multiple of 20. The interval at which the tone correction pattern 1061 is to be formed is not limited to the interval of twenty sheets.

The CPU 314 detects the density value from the reading result of the tone correction pattern 1061 on the intermediate transfer member 106, which is obtained by the image density sensor 117 (Step S92). The CPU 314 creates, based on the density value detected from the tone correction pattern 1061, a γLUT so that the image density of the image to be formed on the intermediate transfer member 106 becomes a target value (Step S93). The CPU 314 stores the created γLUT into the table storage 311. The γLUT is used for the tone correction processing to be performed by the tone corrector 317 at the next image formation timing.

In a case where the instruction of on-sheet correction is given (Step S82: Y), the CPU 314 checks whether or not the density conversion table is already stored in the table storage 311 (Step S83). In a case where no density conversion table is stored (Step S83: N), the CPU 314 creates the density conversion table in accordance with the processing described with reference to FIG. 7, and stores the density conversion table into the table storage 311 (Step S84).

In a case where the density conversion table is stored (Step S83: Y), or in a case where the density conversion table has been created, the CPU 314 controls the printer 101 so as to form the user image indicated by the print job and the tone correction pattern (image for detection) on the recording material 110 (Step S85). In this manner, as exemplified in FIG. 6, the user image and the tone correction pattern 1104 are printed on the recording material 110. At this time, the tone corrector 317 performs tone correction through use of the γLUT created in the previous tone correction processing.

The CPU 314 detects the density value from the reading result of the tone correction pattern 1104 (image for detection) on the recording material 110, which is obtained by the line sensor 138 (Step S86). The CPU 314 converts, based on the density conversion table stored in the table storage 311, the detected density value of the tone correction pattern 1104 on the recording material 110 into a density value of an image on the intermediate transfer member 106 (Step S87).

The CPU 314 creates the γLUT based on the converted density value of the tone correction pattern 1104 so that the image density of the image to be formed on the intermediate transfer member 106 becomes a target value (Step S88). The CPU 314 stores the created γLUT into the table storage 311. The γLUT is used for tone correction processing to be performed by the tone corrector 317 at the next image formation timing.

The CPU 314 which has created the γLUT determines whether or not image formation onto the recording materials 110 corresponding to the printing number set by the print job has ended (Step S89). In a case where the image formation onto the recording materials 110 corresponding to the printing number set by the print job has not ended (Step S89: N), the CPU 314 repeats the process steps of Step S85 to Step S89 until the image formation onto the recording materials 110 corresponding to the printing number set by the print job ends. In the process step of creating the density conversion table in Step S84, the tone correction pattern formed on the recording material 110 is used, and hence one recording material 110 is used. Accordingly, the process step of Step S85 is an operation performed on the second sheet. In a case where the image formation onto the recording materials 110 corresponding to the printing number set by the print job has ended (Step S89: Y), the CPU 314 ends the tone correction processing.

As described above, the tone correction pattern 1104 is formed in the non-image region 1102 of the recording material 110. Accordingly, the tone correction processing can be executed every time the image formation is performed. Thus, the image forming apparatus 100 can maintain an appropriate tone characteristic without stopping the print job for the tone correction. The density value converted in the process step of Step S87 corresponds to the density value to be used in the tone correction processing using the intermediate transfer member 106, and hence the γLUT is created in accordance with the tone correction processing using the intermediate transfer member 106.

Figure 10:
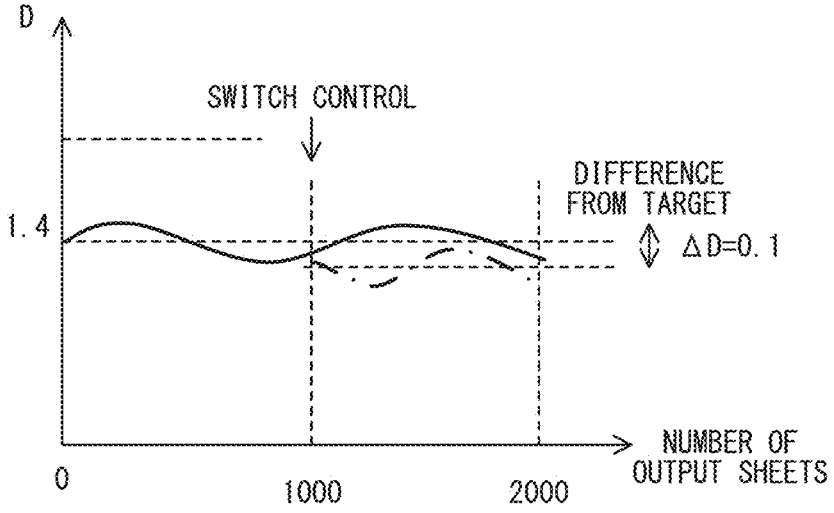
FIG. 10 is an explanatory graph of an effect of the tone correction processing.

FIG. 10 is an explanatory graph of an effect of the tone correction processing described above. The horizontal axis indicates the number of recording materials 110 subjected to image formation (number of output sheets), and the vertical axis indicates an index (D) representing the image density. Output conditions are as follows. The image print signal percentage is 8%. The image formation is performed on 2,000 recording materials 110 being coated paper of 128 g. Until the 1,000th sheet, the tone correction processing is performed by forming the tone correction pattern 1061 on the image bearing member (on the intermediate transfer member 106) for every 100 sheets. From the 1001st sheet on, the tone correction processing is performed by forming the tone correction pattern 1104 on the recording material 110 for each recording material 110.

The solid line indicates the image density in a case in which the image density of the image on the recording material 110 is converted into the image density of the image on the image bearing member, and calibration (tone correction) is performed based on the density information. The long dashed short dashed line indicates the image density in a case in which the target tone of the image on the recording material 110 is determined at the time point of the 1001st sheet so that the calibration (tone correction) is performed. In the long dashed short dashed line, a difference from the original target tone is caused. It is understood that the target tone of the recording material 110 is determined and the correction is performed at a predetermined time point at which the tone is shifted from the target tone on the image bearing member, and hence the image density of the image output as a whole is shifted due to the difference in calibration set by the job as viewed in each job. As described above, it is found that, in the solid line indicating the first embodiment, correction to the target tone is continuously performed and is effective.

In the first embodiment, the tone correction is performed through use of the density conversion table for performing density conversion from the density value of the image on the recording material 110 into the density value of the image on the image bearing member. In this case, the correction frequency is increased by performing the tone correction using the recording material 110. Accordingly, tone correction can be performed finely.

<Determination on Regeneration of Density Conversion Table>

The density conversion table is not required to be updated (regenerated) unless the type of the recording material or the image forming condition is changed. Further, the regeneration of the density conversion table is not desired also from the viewpoint of productivity. However, even in the case of the same type of recording material, when there is a change in image forming condition or a temporal variation, the characteristic of the image density may change so as to reduce the accuracy of the tone correction. Accordingly, the image forming apparatus 100 performs determination on the regeneration of the density conversion table, and regenerates the density conversion table at an appropriate timing.

Three examples of the change in image forming condition, which is one factor of regenerating the density conversion table (conversion condition), are described below.

The first example is a case in which the developing contrast setting, the transfer current setting, the fixing setting, or the like is changed based on user instruction information given from the user or a service worker so that the setting is made to a target offset from the recommended setting. The developing contrast is a difference between a potential of the electrostatic latent image at the time of development and a developing bias to be applied to the developing device 112. The transfer current is a current flowing through the transfer roller 114 at the time of transfer of the toner image. The transfer current is one of transfer conditions at the time when the toner image is transferred onto the recording material 110. The fixing setting is a fixing temperature and a pressure for pressure-contact at the time when the fixing device 150 fixes the toner image to the recording material 110. The fixing setting is one of fixing conditions for fixing the toner image to the recording material 110. For example, when the temperature setting at the time of the fixing processing is adjusted in order to adjust the glossiness of the image to be formed on the recording material 110, the fixing condition is controlled (fixing control is performed). When the setting is changed as described above, even in a case in which the image density of the image on the intermediate transfer member 106 has no change, the image density of the image formed on the recording material 110 changes, and hence the slope of the density conversion table changes.

The second example is a case in which the dither is changed. When the dither is changed, the density after fixing changes based on the dot gain in accordance with the number of lines or the dither shape (dot or line) even in the case of the same laid-on level. Accordingly, the slope of the density conversion table changes.

The third example is a case in which the setting of simplex/duplex printing is changed by the print job. When the setting of simplex/duplex printing is changed, the number of times the recording material 110 passes through the fixing device 150 changes. Accordingly, the density after fixing changes even in the case of the same laid-on level, and thus the slope of the density conversion table changes.

When the above-mentioned tone correction processing is performed and the target tone is updated, all of the stored density conversion tables for the recording materials are discarded, and the density conversion table is newly acquired. The reason therefor is because, in accordance with the change in target tone, the image formation tone value and the image forming conditions for charging, development, and the like also change, and the slope of the density conversion table may change regardless of the recording material.

Two examples of the temporal variation, which is one factor of regenerating the density conversion table, are described below. The term "temporal" refers to an elapsed time or the number of sheets subjected to image formation from a time point at which the density conversion table is created. That is, the determination on the regeneration is performed based on the elapsed time or the number of sheets subjected to image formation from when the density conversion table is created. When the elapsed time is equal to or longer than a predetermined time, or when the number of sheets subjected to image formation is equal to or larger than a predetermined number, the density conversion table is regenerated.

The first example is deterioration of toner (developer) or a component. When the developer is deteriorated, triboelectrification changes, and a transfer efficiency and a scattering amount change. Thus, the image density after fixing changes. Accordingly, the slope of the density conversion table changes. When the component is deteriorated, for example, when a resistance of the intermediate transfer member 106 changes, the transfer efficiency changes, and thus the image density after fixing changes. Accordingly, the slope of the density conversion table changes. In the temporal variation, when the component is replaced, the slope of the density conversion table may change regardless of the type of the recording material, and hence all of the stored density conversion tables for the recording materials are discarded and the density conversion table is newly acquired.

The second example is a change in detection characteristic due to, for example, a window dirt or deterioration of a light source of the image density sensor 117 or the line sensor 138. As the number of recording materials subjected to image formation by the image forming apparatus 100 increases, toner scatters inside of the image forming apparatus 100 and adheres to the glass of the light receiving surface. Accordingly, the image density sensor 117 and the line sensor 138 are regularly subjected to light amount adjustment so as to be controlled to have a constant light receiving amount. In this manner, the reading performance up to a certain density is ensured. However, an accuracy of a highlight portion or a shadow portion changes in accordance with an absolute light amount. For example, when the light amount is large, the light receiving amount of the highlight portion is liable to be saturated. In such a case, even when the relationship between the actual image density of the image on the intermediate transfer member 106 and the image density of the image on the recording material is constant, the slope of the density conversion table changes due to the change in detection characteristic of the sensor.

<Tone Correction Before Regeneration>

When the image forming apparatus 100 has not performed the tone correction for a long period, due to the influence of a state change of the developer or the like, the printer characteristic of Quadrant III shown in FIG. 4 may greatly vary so as to cause a non-linear tone characteristic of Quadrant IV. When the density conversion table is created under this state, deviation is caused in the tone correction pattern to be sampled, and the accuracy of the interpolated part is reduced. Accordingly, when a predetermined time period has elapsed from the previous tone correction, it is desired that the tone correction be performed before the density conversion table is regenerated.

Figure 11:
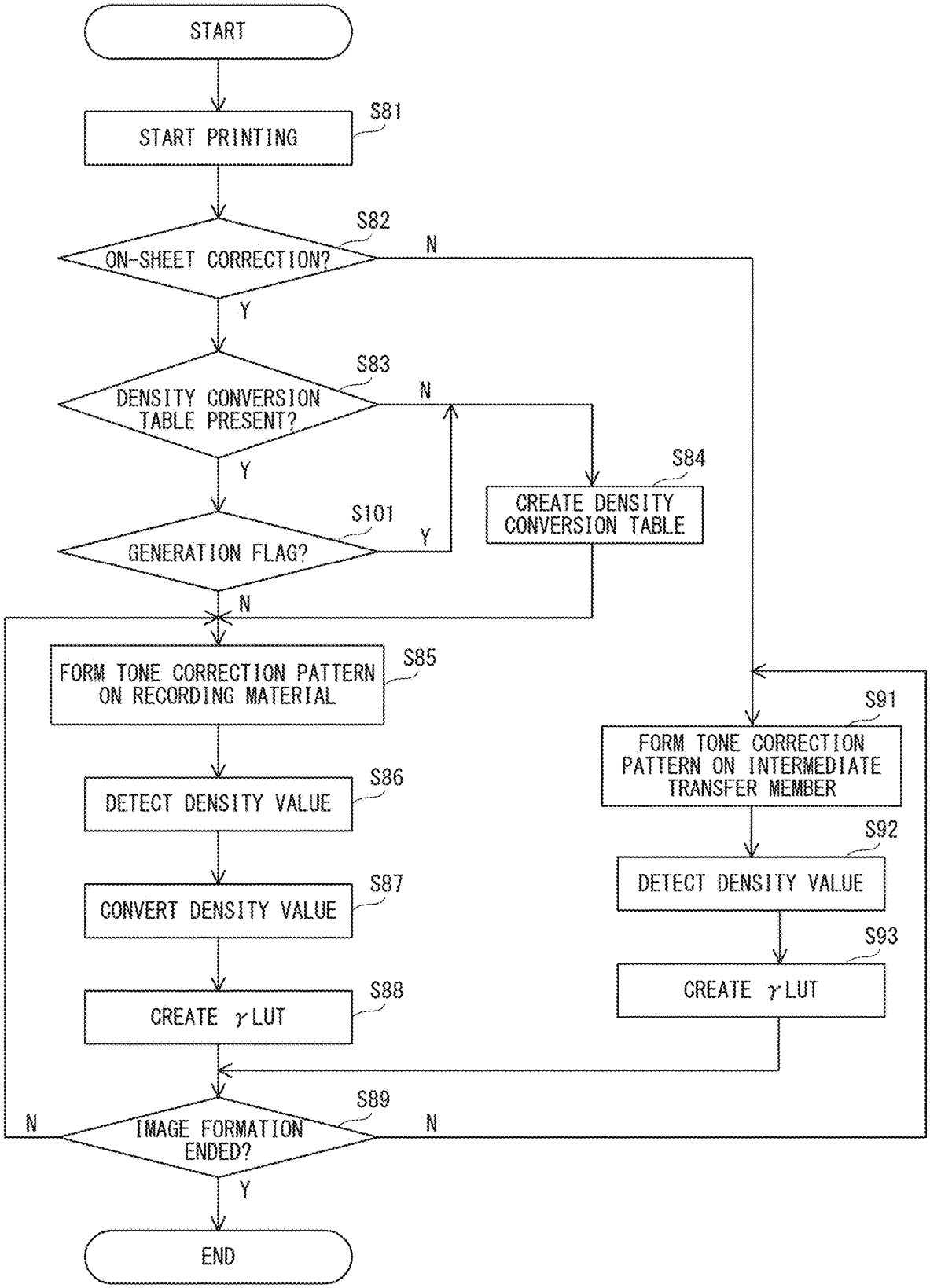
FIG. 11 is a flow chart for illustrating the tone correction processing.

FIG. 11 is a flow chart for illustrating the tone correction processing accompanied with the regeneration of the density conversion table. As described above, the regeneration of the density conversion table is determined based on the change in image forming condition or the temporal variation. The same process steps as those in the tone correction processing of FIG. 9 are denoted by the same step numbers.

Similarly to the process steps of Step S81 to Step S83 of FIG. 9, the printing is started, and it is determined whether the density conversion table is present or absent (Step S81 to Step S83). When no instruction of on-sheet correction is given (Step S82: N), process steps similar to the process steps of Step S91 to Step S93 of FIG. 9 are performed so that the γLUT is created (Step S91 to Step S93). When no density conversion table is stored (Step S83: N), a process step similar to the process step of Step S84 of FIG. 9 is performed so that the density conversion table is created and stored into the table storage 311 (Step S84).

When the density conversion table is stored (Step S83: Y), the CPU 314 checks a regeneration flag indicating whether or not to perform the regeneration of the density conversion table (Step S101). When the regeneration of the density conversion table is set in the regeneration flag (Step S101: Y), the CPU 314 creates the density conversion table by a process step similar to the process step of Step S84 of FIG. 9 (Step S84). When the regeneration of the density conversion table is not set in the regeneration flag (Step S101: N), the CPU 314 creates the γLUT by process steps similar to the processes of Step S85 to Step S89 of FIG. 9 (Step S85 to Step S89).

FIG. 12 is an explanatory table of information to be used for the determination on the regeneration. In the first embodiment, a density conversion table creation time, the number of sheets subjected to image formation (number of output sheets) after the density conversion table is created, the developing contrast setting, the transfer current setting, the fixing setting, the dither, the simplex/duplex printing setting, a sensor light amount on the image bearing member, and a sensor light amount after the fixing are used for the determination on the regeneration.

When the elapsed time from the density conversion table creation time or the number of output sheets after the density conversion table is created exceeds a predetermined value, it is determined to perform the regeneration of the density conversion table. In the first embodiment, threshold values of one day or more and 50,000 sheets or more are set for the elapsed time and the number of output sheets, respectively. When the elapsed time has become one day or more or the number of output sheets has become 50.000 sheets or more, the regeneration flag of the density conversion table is set.

In the developing contrast setting, the transfer current setting, and the fixing setting, when a target offset from the recommended setting is set based on the user instruction information given from the user or the service worker, it is determined to perform the regeneration of the density conversion table. When the target offset from the recommended setting is set, the regeneration flag of the density conversion table is set. The user instruction information is input from the operation panel 180.

When the dither is changed through adjustment performed by the user or the service worker, it is determined to perform the regeneration of the density conversion table. When the dither is changed, the regeneration flag of the density conversion table is set. When the print job of the simplex/duplex printing is switched, it is determined to perform the regeneration of the density conversion table. When the setting in the simplex printing and the duplex printing is changed, the regeneration flag of the density conversion table is set.

Regarding the image density sensor light amount and the line sensor light amount, when the light amount output from each sensor is changed by a predetermined threshold value or more, it is determined to perform the regeneration of the density conversion table. In the first embodiment, a threshold value of 10% is set for each light amount. When at least one of the light amount output from the image density sensor or the light amount output from the line sensor is changed by 10% or more, the regeneration flag of the density conversion table is set.

Even when a condition related to each item is switched, the density conversion table in the same condition is held in an internal memory, and unless the condition corresponds to the condition of the elapsed time or the like, the regeneration is not performed and the held density conversion table is used.

A method of resetting the density conversion table is described. When the user or the service worker replaces a component or the tone correction processing is performed based on the instruction from the user, the CPU 314 deletes the density conversion table stored in the table storage 311. In this manner, at the time of the next print job, the density conversion table is newly created. In this case, it is desired that the tone correction be performed before the print job is started. When no tone correction has been performed, the tone correction may be performed before the density conversion table is acquired.

As described above, the determination on the acquisition of the density conversion table to be used for performing the tone correction is made so that the downtime required for the acquisition can be reduced. Further, the acquisition at an appropriate timing allows suppression of reduction in tone correction accuracy.

Figure 13A:
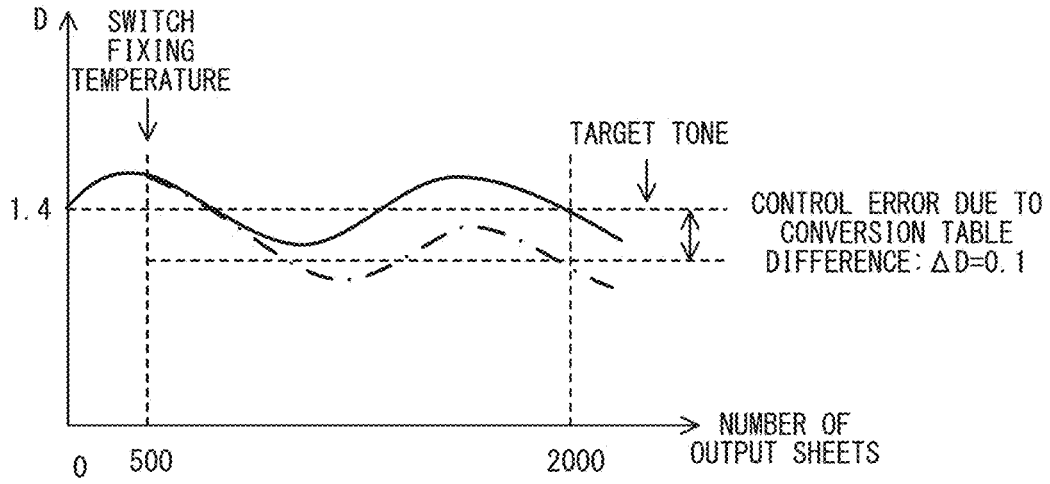
FIG. 13A and FIG. 13B are explanatory graphs of an effect in a case in which the density conversion table is regenerated.
Figure 13B:
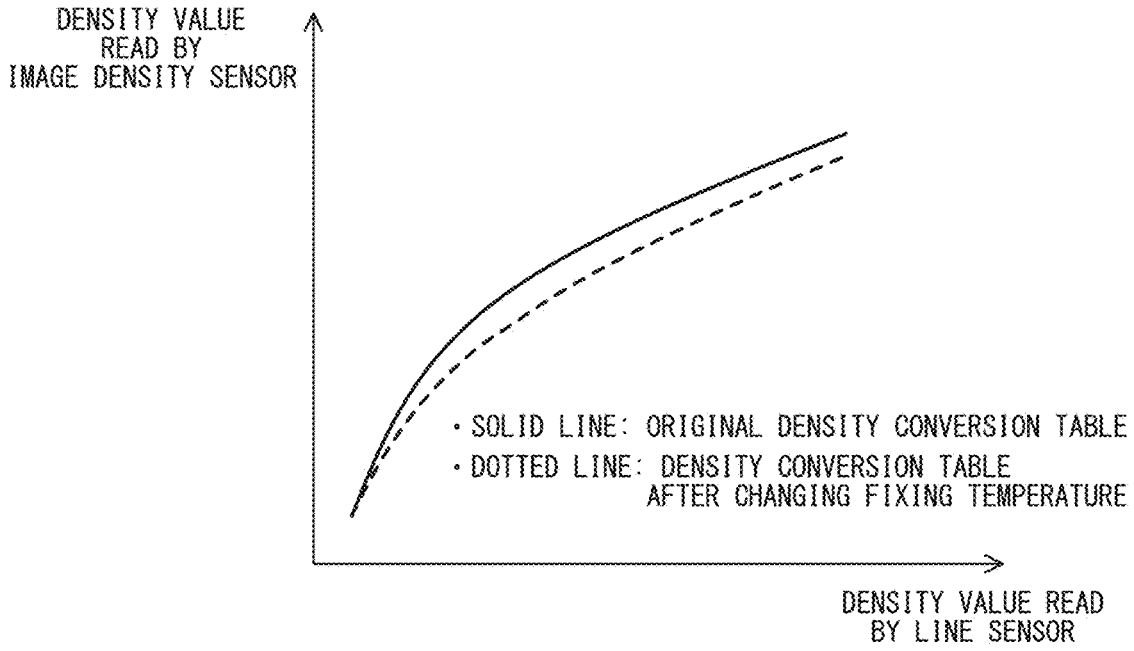

FIG. 13A and FIG. 13B are explanatory graphs of an effect in a case in which the density conversion table is regenerated in accordance with the change in image forming condition or the temporal variation. In FIG. 13A, the horizontal axis indicates the number of output sheets, and the vertical axis indicates the index (D) representing the image density. Output conditions are as follows. The image print signal percentage is 8%, and the recording material 110 is the same glossy paper. Further, until the 500th sheet, the tone correction processing is performed by forming the tone correction pattern on the recording material 110, and thereafter the setting of increasing the fixing temperature is performed in order to adjust the glossiness. From the 501st sheet on, the tone correction processing is similarly performed by forming the tone correction pattern on the recording material 110. The solid line indicates a result obtained by performing regeneration of the density conversion table after the setting of the fixing temperature is changed, and indicates the image density in a case in which the calibration (tone correction) is performed through use of the regenerated density conversion table. The long dashed short dashed line indicates the image density in a case in which the calibration (tone correction) is performed while continuously using the density conversion table at the time point of the first sheet without regenerating the density conversion table.

The reason why a difference from the original target tone is caused in the long dashed short dashed line is described. FIG. 13B is an explanatory graph of the density conversion table for showing the relationship between the image density of the image on the intermediate transfer member 106 and the image density of the image on the recording material 110. The solid line of FIG. 13B indicates the density conversion table at the time point of the first sheet, and the dotted line indicates the density conversion table at the time point of the 501st sheet after the setting of the fixing temperature is changed. It is understood that, because the fixing temperature is increased, even in the case of the same image on the intermediate transfer member 106, the dotted line has a higher image density of the image on the recording material 110. When no regeneration of the density conversion table is performed, the image density detected from the recording material 110 is increased due to a density conversion error, and hence the γLUT is adjusted so as to decrease the image density. Accordingly, the long dashed short dashed line of FIG. 13A is lowered from the original target tone. As described above, the effectiveness of the first embodiment is shown.

Second Embodiment

In the first embodiment, the determination on the regeneration of the density conversion table is performed based on the condition associated with the density conversion table. However, there may be a case in which the regeneration of the density conversion table is required even when the condition is not satisfied. In a second embodiment of the present disclosure, data for comparison with the density conversion table is acquired at the time of the first sheet or regularly during the job, and the density conversion table and the data for comparison are compared with each other. When a difference of the comparison result is large, the density conversion table is updated. As the data for comparison, a density conversion table created at a timing different from that of the density conversion table used in the previous tone correction is used. In this manner, tone correction with higher accuracy is allowed.

Figure 14:
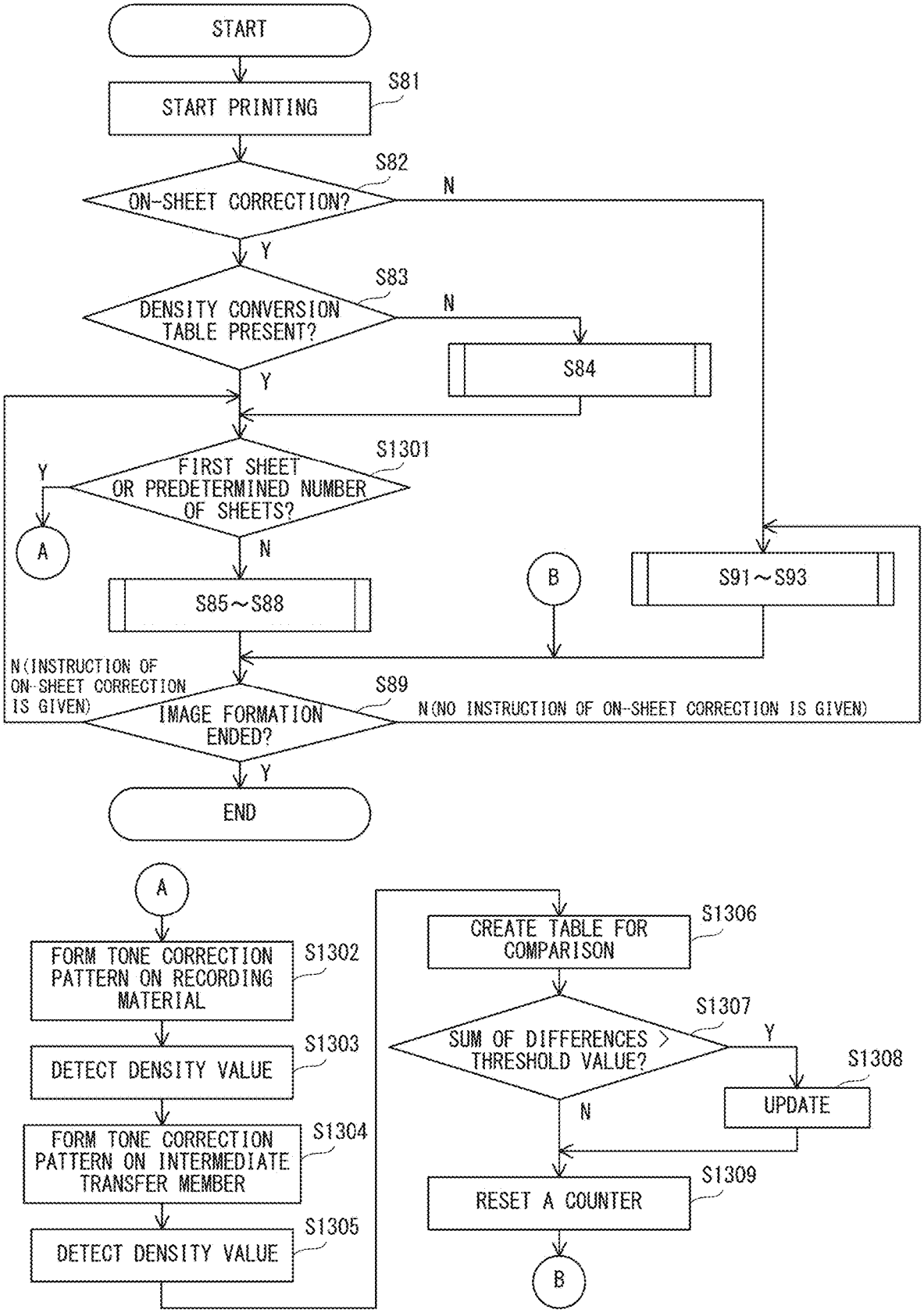
FIG. 14 is a flow chart for illustrating the tone correction processing.

FIG. 14 is a flow chart for illustrating the tone correction processing in the second embodiment. The same process steps as those of the tone correction processing of FIG. 9 are denoted by the same step numbers. Similarly to the process steps of Step S81 to Step S83 of FIG. 9, the printing is started, and it is determined whether the density conversion table is present or absent (Step S81 to Step S83). When no instruction of on-sheet correction is given (Step S82: N), process steps similar to the process steps of Step S91 to Step S93 of FIG. 9 are performed so that the γLUT is created (Step S91 to Step S93). When no density conversion table is stored (Step S83: N), a process step similar to the process step of Step S84 of FIG. 9 is performed so that the density conversion table is created and stored into the table storage 311 (Step S84).

When the density conversion table is stored (Step S83: Y), the CPU 314 determines whether or not the process is for the first sheet of the print job or printing of a predetermined number of sheets has been performed (Step S1301). When the process is not for the first sheet of the job or the printing of the predetermined number of sheets has not been performed (Step S1301: N), the CPU 314 creates the γLUT by process steps similar to the process steps of Step S85 to Step S88 of FIG. 9 (Step S85 to Step S88).

When the process is for the first sheet of the job or the printing of the predetermined number of sheets has been performed (Step S1301: Y), the CPU 314 detects the density value of the tone correction pattern formed on the recording material 110 by process steps similar to the process steps of Step S85 and Step S86 of FIG. 9 (Step S1302 and Step S1303).

The CPU 314 causes the engine control unit 102 to control the engine unit 1011 so as to form the tone correction pattern on the intermediate transfer member 106 (Step S1304). This process is performed not to create the density conversion table but to perform the determination on the regeneration. Accordingly, the tone correction pattern formed in this process may have a smaller number of tone levels than that of the tone correction pattern 1061 for creating the density conversion table, which is illustrated in FIG. 5. When specific tone levels are only used, a toner consumption amount can be suppressed. The CPU 314 causes the engine control unit 102 to control the image density sensor 117 so as to read the tone correction pattern formed on the intermediate transfer member 106. The CPU 314 detects the density value of the tone correction pattern based on the detection result obtained by the image density sensor 117 (Step S1305).

The CPU 314 creates the table for comparison (Step S1306). The CPU 314 creates the density conversion table through use of the density value detected from the tone correction pattern of the intermediate transfer member 106 in the process step of Step S1305 and the density value detected from the tone correction pattern of the recording material 110 in the process step of Step S1303. At this time, the CPU 314 selects the density value of the tone correction pattern formed on the recording material 110 so as to correspond to the density value of the tone correction pattern formed on the intermediate transfer member 106, to thereby create the table for comparison.

Figure 15:
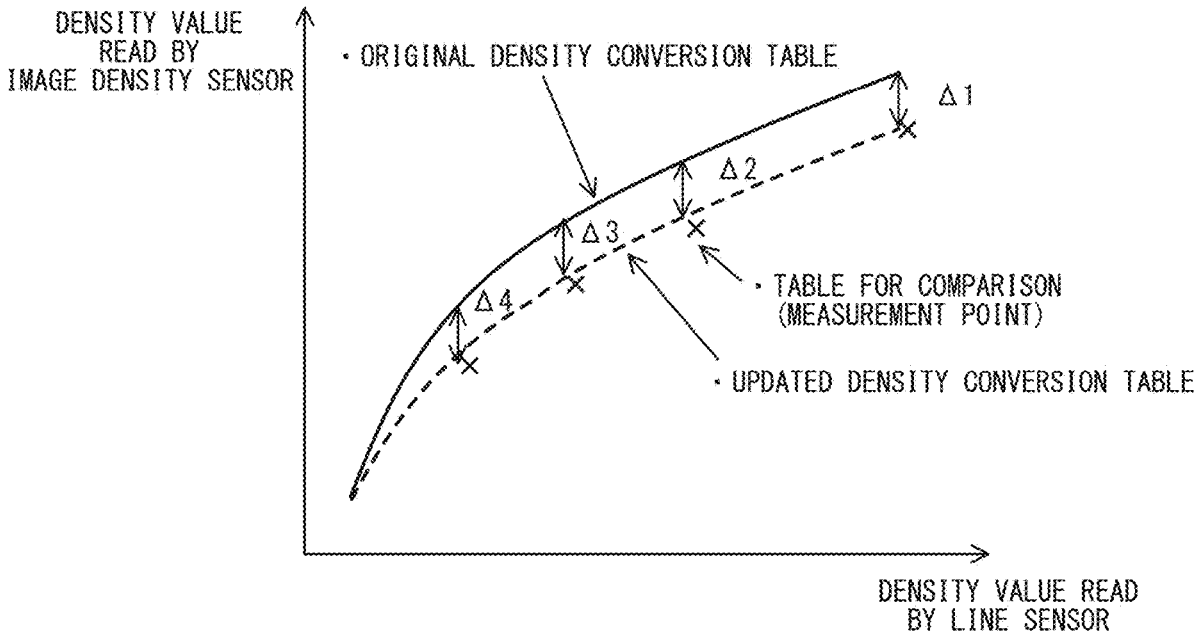
FIG. 15 is an explanatory graph of processing of comparing the density conversion table and a table for comparison with each other.

The CPU 314 compares the original density conversion table and the table for comparison with each other (Step S1307). FIG. 15 is an explanatory graph of processing of comparing the original density conversion table and the table for comparison with each other. The CPU 314 compares the original density conversion table (solid line) and the table for comparison (marks "x") with each other in each tone level, and calculates differences Δ1 to Δ4. As a result of the comparison, when the sum of the differences Δ1 to Δ4 exceeds a threshold value, the CPU 314 determines to update the density conversion table (Step S1307: Y). The CPU 314 transmits, as indicated by the dotted line of FIG. 15, a difference ratio between the original density conversion table and the table for comparison to other tones, to thereby update the density conversion table (Step S1308). When the sum of the differences Δ1 to Δ4 does not exceed the threshold value, the CPU 314 determines not to update the density conversion table (Step S1307: N). After the creation of the density conversion table is finished, the CPU 314 resets a counter for a predetermined number of sheets (Step S1309).

The CPU 314 determines whether or not the image formation has ended similarly to the process step of Step S89 of FIG. 9 (Step S89). When the image formation onto the recording materials 110 corresponding to the printing number set by the print job has not ended (Step S89: N (instruction of on-sheet correction is given)), the CPU 314 repeats the process steps of Step S1301 and the subsequent steps until the image formation onto the recording materials 110 corresponding to the printing number set by the print job is ended. When the image formation onto the recording materials 110 corresponding to the printing number set by the print job has ended (Step S89: Y), the CPU 314 ends the tone correction processing.

As described above, the determination on the acquisition of the density conversion table to be used for performing the tone correction is made so that the downtime required for the acquisition can be reduced. Further, the acquisition of the density conversion table at an appropriate timing allows suppression of reduction in tone correction accuracy.

The image forming apparatus 100 of each of the first and second embodiments may execute both of the on-sheet correction and the tone correction using the intermediate transfer member 106 (image bearing member) when the on-sheet correction is effective. In this case, the tone correction pattern 1104 is formed on each page of the recording material 110, and the tone correction pattern 1061 is formed at an interval of a predetermined number of sheets.

In the first and second embodiments, the case in which tone correction is performed as calibration has been described, but the present disclosure is not limited thereto. The present disclosure is effective for calibration to be performed by each of different methods through use of the recording material 110 and the image bearing member.

Third Embodiment

Figure 16:
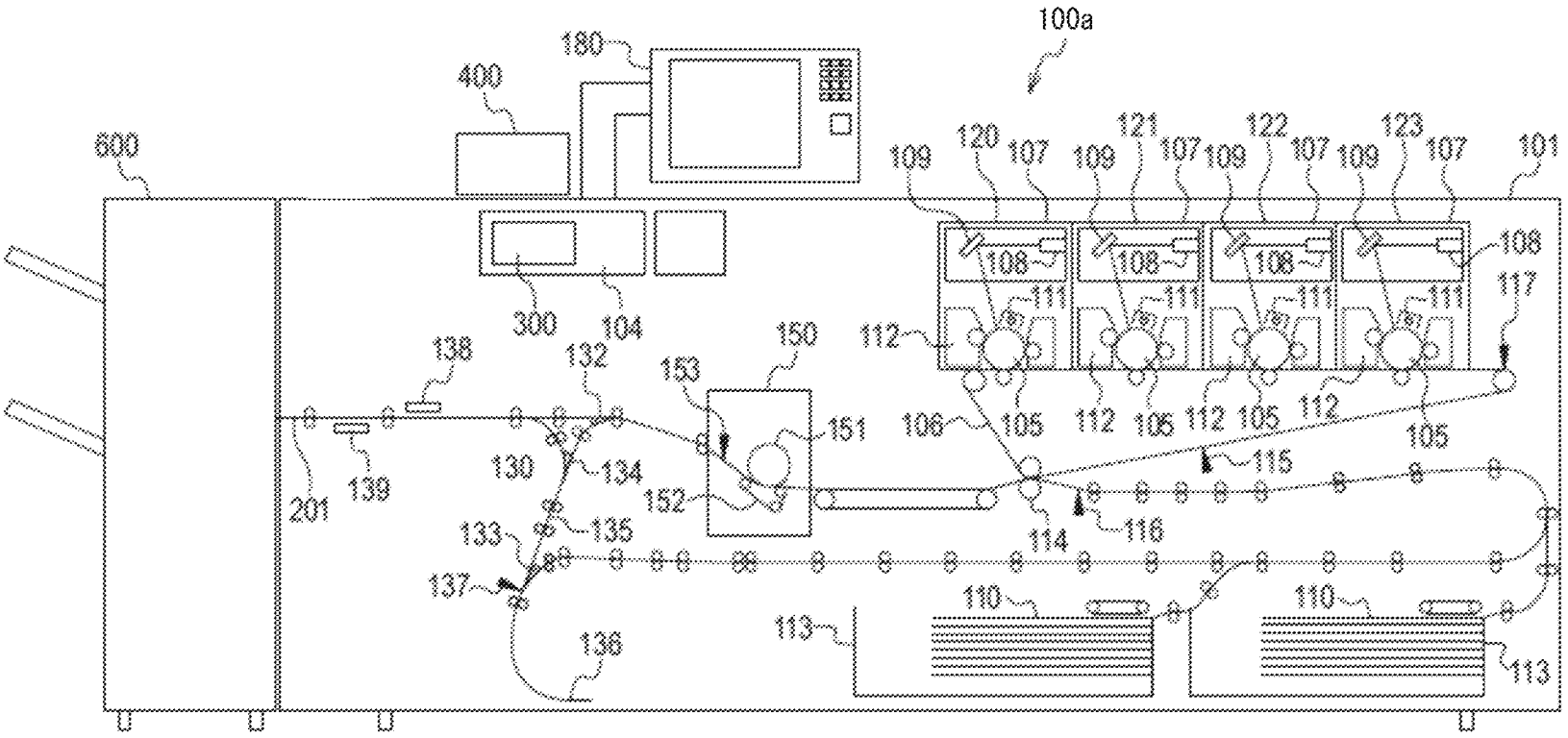
FIG. 16 is a configuration view of an image forming apparatus.

FIG. 16 is a schematic sectional view of an image forming apparatus 100*a* of a third embodiment of the present disclosure. The image forming apparatus 100*a* has a configuration obtained by adding a line sensor 139 to the image forming apparatus 100 of FIG. 1. The line sensor 139 has a configuration similar to that of the line sensor 138, and is arranged on the downstream side with respect to the line sensor 138 in the conveying direction of the recording material 110. Further, the line sensor 139 is added to the engine unit 1011 of FIG. 3.

The printer 101 includes a conveyance mechanism 130 for controlling the conveying direction of the recording material 110 on the downstream of the fixing device 150 in the conveying direction in which the recording material 110 is to be conveyed. The conveyance mechanism 130 includes the flappers 132, 133, and 134, the conveyance path 135, the reverse portion 136, and the sensor 137.

When images are to be formed on both surfaces of the recording material 110, the recording material 110 having an image formed on its first surface is conveyed to the conveyance path 135 by the flapper 132, and is conveyed to the reverse portion 136 by the flapper 133. After the edge of the recording material 110 is detected by the sensor 137, the conveyance of the recording material 110 is temporarily stopped at a position at which the end portion of the recording material 110 passes through the sensor 137. After that, the conveying direction is controlled to an opposite direction by a roller (not shown). The flapper 133 conveys the recording material 110 whose conveying direction is controlled to the opposite direction to a duplex printing conveyance path. In this manner, the recording material 110 passes through the transfer nip under a state in which the front and back sides are reversed. Then, the recording material 110 having an image formed on its second surface is conveyed to the conveyance path 201 by the flapper 132.

Further, when an image is to be formed on only one surface, the image forming apparatus 100*a* can control whether to discharge the sheet with an image-formed surface facing upward or to discharge the sheet with the image-formed surface facing downward, based on the print setting (sheet discharge surface setting). Face-up sheet discharge refers to the sheet discharge surface setting in which the recording material 110 is discharged with the image-formed surface facing upward, and face-down sheet discharge refers to the sheet discharge surface setting in which the recording material 110 is discharged with the image-formed surface facing downward.

In this case, for example, when the face-up sheet discharge is executed, the recording material 110 having an image formed thereon is conveyed to the conveyance path 201 by the flapper 132. In this manner, the recording material 110 discharged to a tray of the finisher 600 is stacked with the image-formed surface facing upward. The conveyance path 201 is a common conveyance path through which both of the recording material 110 whose front and back sides are reversed at the reverse portion 136 and the recording material 110 whose front and back sides are not reversed pass.

Meanwhile, when the face-down sheet discharge is executed, the recording material 110 having an image formed thereon is conveyed to the conveyance path 135 by the flapper 132. After the edge of the recording material 110 is detected by the sensor 137, the conveyance of the recording material 110 is temporarily stopped. After that, the conveying direction is controlled to the opposite direction by the roller (not shown). Then, the recording material 110 is conveyed to the conveyance path 201 by the flapper 134. In this manner, the recording material 110 discharged to the tray of the finisher 600 is stacked with the image-formed surface facing downward.

The tone correction processing to be performed by forming the tone correction pattern 1061 of FIG. 5 on the intermediate transfer member 106 is referred to as "first tone correction processing." The tone correction processing to be performed by forming the tone correction pattern 1104 of FIG. 6 on the recording material 110 is referred to as "second tone correction processing."

The tone correction pattern 1104 on the recording material 110 is read by the line sensor 138 or the line sensor 139. When the face-up sheet discharge is set, the tone correction pattern 1104 on the recording material 110 is read by the line sensor 138. Meanwhile, when the face-down sheet discharge is set, the tone correction pattern 1104 on the recording material 110 is read by the line sensor 139. Further, also in the duplex printing mode in which images are formed on both surfaces, the tone correction pattern 1104 on the recording material 110 is read by the line sensor 139.

When the line sensor 138 reads the tone correction pattern 1104, the tone correction patterns 1104 for yellow and cyan on the recording material 110 pass through a reading region of the line sensor 138. When the line sensor 138 reads the tone correction pattern 1104, the tone correction patterns 1104 for magenta and black pass through the reading region of the line sensor 138 after the tone correction patterns 1104 for yellow and cyan pass therethrough. Meanwhile, when the line sensor 139 reads the tone correction pattern 1104, the tone correction patterns 1104 for magenta and black on the recording material 110 pass through a reading region of the line sensor 139. When the line sensor 139 reads the tone correction pattern 1104, the tone correction patterns 1104 for yellow and cyan pass through the reading region of the line sensor 139 after the tone correction patterns 1104 for magenta and black pass therethrough.

<Creation of Density Conversion Table>

In the second tone correction processing, a measurement result of the tone correction pattern 1104 is converted into a density value of the image formed on the intermediate transfer member 106. The reason therefor is because, when the target density of the first tone correction processing and the target density of the second tone correction processing are different from each other, the image density becomes unstable. When the density value acquired in the tone correction is controlled to become the target density on the intermediate transfer member 106, the stability of the image density can be easily achieved even when the tone correction to be executed is switched. In view of the above, the CPU 314 generates a conversion condition for converting a reading result of an image for measurement on the recording material 110 into a density of an image for measurement on the intermediate transfer member 106.

Further, the image forming apparatus 100*a* includes two line sensors 138 and 139. In this case, the line sensors 138 and 139 have individual differences. Thus, in order to stabilize the image density with high accuracy, the CPU 314 generates, for each of the line sensors 138 and 139, a conversion condition for converting the reading result of the image for measurement on the recording material 110 into the density of the image for measurement on the intermediate transfer member 106. That is, the CPU 314 generates a conversion condition for converting the reading result of the image for measurement, which is obtained by the line sensor 138, into the measurement result obtained by the image density sensor 117, and a conversion condition for converting the reading result of the image for measurement, which is obtained by the line sensor 139, into the measurement result obtained by the image density sensor 117.

The above-mentioned conversion conditions are a density conversion table for converting a luminance signal of the line sensor 138 into a density value, and a density conversion table for converting a luminance signal of the line sensor 139 into a density value. The conversion conditions may be a density conversion table for converting the luminance signal of the line sensor 138 into an output value (voltage) of the image density sensor 117, and a density conversion table for converting the luminance signal of the line sensor 139 into the output value (voltage) of the image density sensor 117. As another example, the conversion conditions may each be a density conversion table for converting a density value obtained from the luminance signal of the line sensor 138 (or the line sensor 139) into a density value obtained from the output value of the image density sensor 117.

<Creation and Selection of Density Conversion Table>

In the image forming apparatus 100*a*, the direction of the tone correction pattern 1104 formed on the recording material 110 passing through the conveyance path 201 changes depending on the sheet discharge surface setting. The reason therefor is because the tone correction pattern 1104 is formed on the first surface. Accordingly, the CPU 314 selects whether to use the density conversion table for the line sensor 138 or to use the density conversion table for the line sensor 139 depending on the sheet discharge surface setting. Moreover, the CPU 314 controls whether to generate the density conversion table for the line sensor 138 or to generate the density conversion table for the line sensor 139 depending on the sheet discharge surface setting.

Next, the processing of generating the density conversion table is described with reference to the flow chart of FIG. 17. When the CPU 314 receives an instruction to execute the processing of generating the density conversion table, the CPU 314 reads out a program from the program ROM 304 and loads the program onto the RAM 310, to thereby execute each step of FIG. 17.

First, the CPU 314 causes the tone correction pattern 1104 to be formed on the recording material 110 (Step S170). The formation of the tone correction pattern 1104 is executed based on the instruction from the engine control unit 102, and hence, in Step S170, the CPU 314 instructs the engine control unit 102 to form the tone correction pattern 1104.

The tone correction pattern 1104 to be formed in Step S170 is an image for measurement to be measured in order to generate the density conversion table. Accordingly, the tone correction pattern 1104 to be formed in Step S170 may bean image having a tone different from that of the tone correction pattern 1104 to be formed in order to generate the γLUT, which is illustrated in FIG. 6.

Figure 20:
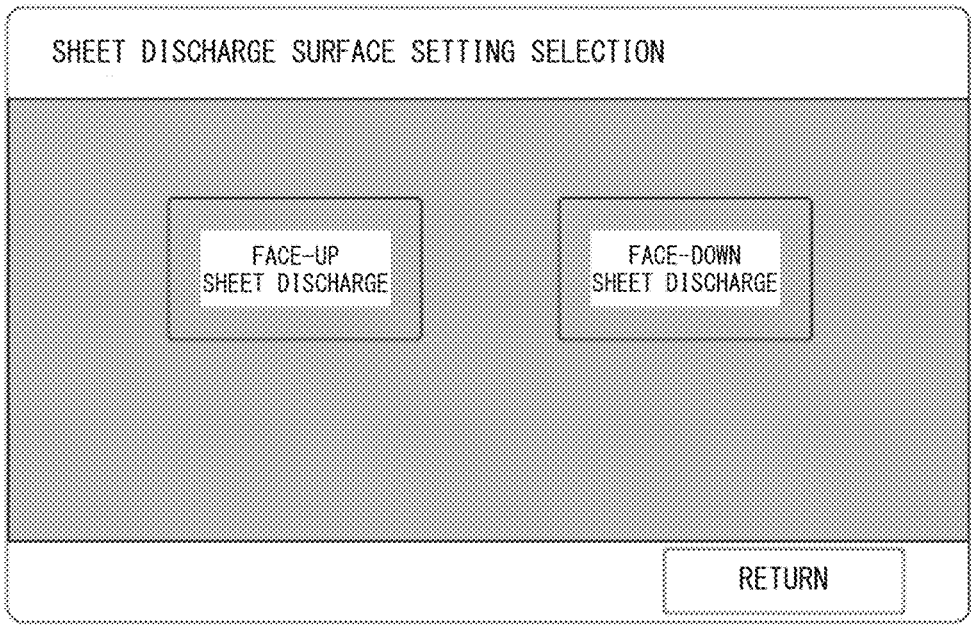
FIG. 20 is a schematic view of a setting screen.

Next, the CPU 314 determines whether or not the sheet discharge surface setting is set to the face-up sheet discharge (Step S171). FIG. 20 is a setting screen for setting the sheet discharge surface setting, which is to be displayed on the operation panel 180. The user can select the face-up sheet discharge or the face-down sheet discharge on the setting screen illustrated in FIG. 20. When nothing is set in the print setting, the face-down sheet discharge is selected. The CPU 314 receives the user instruction information indicating the sheet discharge surface setting from the operation panel 180.

When the face-up sheet discharge is set in Step S171, the CPU 314 causes the line sensor 138 to read the tone correction pattern 1104 (Step S172). In Step S172, the engine control unit 102 controls the line sensor 138 based on the instruction from the CPU 314 so that the line sensor 138 reads the tone correction pattern 1104 on the recording material 110. The luminance signal of the line sensor 138 is converted into a density value A1, and the CPU 314 acquires the density value A1 transmitted from the engine control unit 102.

Next, the CPU 314 causes the tone correction pattern 1061 to be formed on the intermediate transfer member 106 (Step S173). The formation of the tone correction pattern 1061 is executed based on the instruction from the engine control unit 102, and hence, in Step S173, the CPU 314 instructs the engine control unit 102 to form the tone correction pattern 1061.

In this case, the tone correction pattern 1061 to be formed in Step S173 is an image for measurement to be measured in order to generate the density conversion table. Accordingly, the tone correction pattern 1061 to be formed in Step S173 may be an image having a tone different from that of the tone correction pattern 1061 to be formed in order to generate the γLUT, which is illustrated in FIG. 5.

Next, the CPU 314 causes the image density sensor 117 to read the tone correction pattern 1061 (Step S174). In Step S174, the engine control unit 102 controls the image density sensor 117 based on the instruction from the CPU 314 so that the image density sensor 117 reads the tone correction pattern 1061 on the intermediate transfer member 106. The output value (voltage) of the image density sensor 117 is converted into a density value B1, and the CPU 314 acquires the density value B1 transmitted from the engine control unit 102.

Then, the CPU 314 generates a density conversion table 1140 based on the density value A1 acquired in Step S172 and the density value B1 acquired in Step S174 (Step S175). The density conversion table 1140 generated in Step S175 is stored into the table storage 311, and the CPU 314 ends the processing of generating the density conversion table.

Further, when the face-down sheet discharge is set in Step S171, the engine control unit 102 causes the conveyance mechanism 130 to stop the recording material 110 at the reverse portion 136 and convey the recording material 110 from the reverse portion 136 to the conveyance path 201. In this manner, the recording material 110 is conveyed so that the tone correction pattern (image for measurement) 1104 is directed so as to be opposed to the line sensor 139.

Then, the CPU 314 causes the line sensor 139 to read the tone correction pattern 1104 (Step S176). In Step S176, the engine control unit 102 controls the line sensor 139 based on the instruction from the CPU 314 so that the line sensor 139 reads the tone correction pattern 1104 on the recording material 110. The luminance signal of the line sensor 139 is converted into a density value A2, and the CPU 314 acquires the density value A2 transmitted from the engine control unit 102.

Next, the CPU 314 causes the tone correction pattern 1061 to be formed on the intermediate transfer member 106 (Step S177). The formation of the tone correction pattern 1061 is executed based on the instruction from the engine control unit 102, and hence, in Step S177, the CPU 314 instructs the engine control unit 102 to form the tone correction pattern 1061.

In this case, the tone correction pattern 1061 to be formed in Step S177 is an image for measurement to be measured in order to generate the density conversion table. Accordingly, the tone correction pattern 1061 to be formed in Step S177 may be an image having a tone different from that of the tone correction pattern 1061 to be formed in order to generate the γLUT, which is illustrated in FIG. 5.

Next, the CPU 314 causes the image density sensor 117 to read the tone correction pattern 1061 (Step S178). In Step S178, the engine control unit 102 controls the image density sensor 117 based on the instruction from the CPU 314 so that the image density sensor 117 reads the tone correction pattern 1061 on the intermediate transfer member 106. The output value (voltage) of the image density sensor 117 is converted into a density value B2, and the CPU 314 acquires the density value B2 transmitted from the engine control unit 102.

Then, the CPU 314 generates a density conversion table 1141 based on the density value A2 acquired in Step S176 and the density value B2 acquired in Step S178 (Step S179). The density conversion table 1141 generated in Step S179 is stored into the table storage 311, and the CPU 314 ends the processing of generating the density conversion table.

Figure 17:
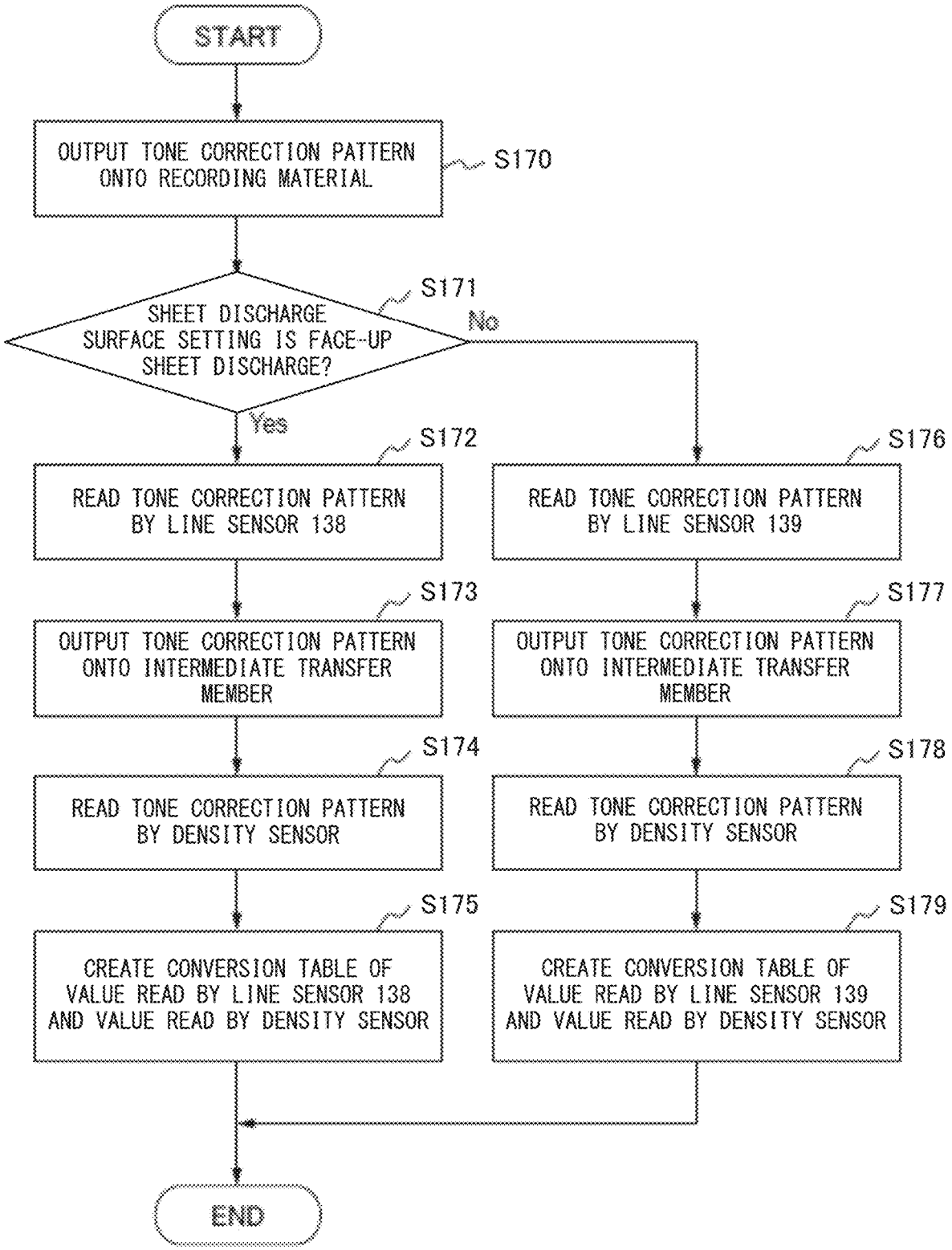
FIG. 17 is a flow chart for illustrating the processing of creating the density conversion table.

In the processing of generating the density conversion table of FIG. 17, the tone correction pattern 1061 is formed after the tone correction pattern 1104 is formed, but the order to form the tone correction pattern 1104 and the tone correction pattern 1061 is not limited to the above-mentioned order. There may be employed a configuration in which the tone correction pattern 1061 is formed first, and then the tone correction pattern 1104 is formed. When this configuration is employed, the user instruction information indicating the sheet discharge surface setting may be acquired in advance.

Further, it is suitable to create (generate) the density conversion table 1140 (or 1141) at the timing at which it is determined that the recording material is used for the first time. There may be employed a configuration in which the generation of the density conversion table 1140 (or 1141) is executed based on, for example, the user instruction information input from the operation panel 180.

Figure 19:
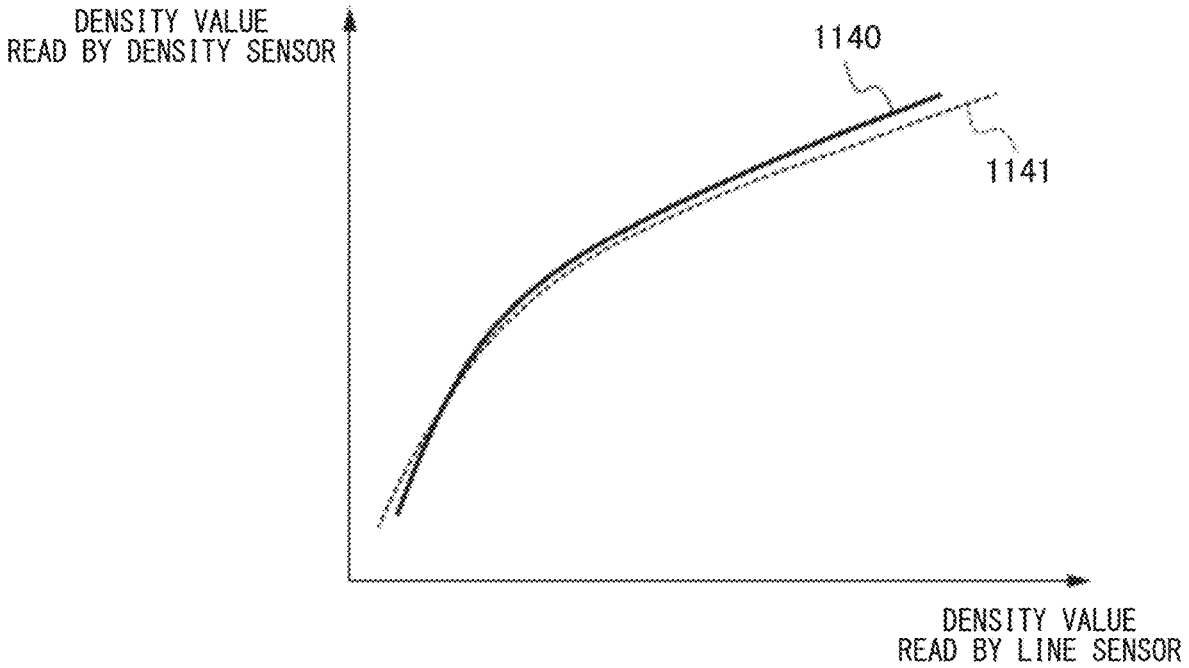
FIG. 19 is an exemplary graph of a density conversion table (1141).

FIG. 19 is an exemplary graph of the density conversion table 1140 and the density conversion table 1141. In FIG. 19, the vertical axis indicates the density value obtained from the measurement result obtained by the image density sensor 117, and the horizontal axis indicates the density value obtained from the measurement result obtained by the line sensor 138 or 139. It is understood from FIG. 19 that the line sensor 138 and the line sensor 139 have individual differences. In the tone correction to be carried out after the processing of generating the density conversion table is executed, the CPU 314 converts the reading result of the tone correction pattern 1104 into the density value based on the corresponding density conversion table 1140 or 1141.

<Tone Correction Control>

The second tone correction processing is achieved through cooperation between the CPU 314 and the engine control unit 102 for controlling the line sensors 138 and 139. When the second tone correction processing is executed, the CPU 314 functioning as the automatic tone correction generator 307 generates the γLUT based on the reading result of the tone correction pattern 1104 obtained by the line sensor 138 or 139. Then, the tone corrector 317 converts the image data (density signal) based on the γLUT generated by the automatic tone correction generator 307. Then, the engine unit 1011 forms an image based on the image data (laser output signal) converted by the tone corrector 317. In this manner, the tone characteristic of the image to be formed by the engine unit 1011 is controlled to have an ideal tone characteristic. In the second tone correction processing, the tone correction pattern 1104 is repeatedly formed on a plurality of recording materials 110. Then, the γLUT is generated based on a value obtained by averaging the density values of the tone correction patterns 1104 formed on the plurality of recording materials 110.

Next, image formation processing including the tone correction processing is described with reference to the flow chart of FIG. 18. When the image forming apparatus 100*a* receives an instruction to execute the image formation processing of forming an image based on a job, the CPU 314 reads out a program from the program ROM 304 and loads the program onto the RAM 310, to thereby execute each step of FIG. 18.

First, the CPU 314 instructs the engine control unit 102 to start the image formation processing, and starts the job printing (Step S181). The CPU 314 determines whether or not the execution of the second tone correction processing is effective based on the user instruction information indicating the tone correction, which is input from the operation panel 180 (Step S182). When the execution of the second tone correction processing is allowed in Step S182, the CPU 314 checks the set content of the sheet discharge surface setting (Step S183). The CPU 314 determines whether or not the density conversion table corresponding to the sheet discharge surface setting checked in Step S183 is stored in the table storage 311 (Step S184).

When the density conversion table corresponding to the sheet discharge surface setting is not stored in the table storage 311 in Step S184, the CPU 314 executes the processing of generating the density conversion table illustrated in FIG. 17 (Step S185). In Step S185, the density conversion table corresponding to the currently-set sheet discharge surface setting is stored into the table storage 311. After the processing of generating the density conversion table is executed, the CPU 314 increments a count value for counting the number of output sheets by 1, and advances the process to Step S186 to be described later.

Meanwhile, when the density conversion table corresponding to the sheet discharge surface setting is stored in the table storage 311 in Step S184, the CPU 314 forms the tone correction pattern 1104 on the recording material 110 together with the user image based on the job (Step S186). In Step S186, the CPU 314 transmits the laser output signal to the engine control unit 102 for controlling the engine unit 1011 so as to cause the user image and the tone correction pattern 1104 to be formed on the recording material 110.

The CPU 314 causes the line sensor 138 or 139 to read the tone correction pattern 1104 (Step S187). In Step S187, the engine control unit 102 controls the line sensor 138 or 139 based on the instruction from the CPU 314 so as to read the tone correction pattern 1104 on the recording material 110. The luminance signal of the line sensor 138 or 139 is converted into the density value. The CPU 314 acquires the density value transmitted from the engine control unit 102. Then, the CPU 314 converts the density value based on the density conversion table 1140 or 1141 corresponding to the line sensor 138 or 139 that has read the tone correction pattern 1104 (Step S188).

The CPU 314 generates the γLUT based on the density value converted in Step S188 (Step S189), and determines whether or not the count value of the number of output sheets has reached the number of output sheets set in the job (Step S190). When the count value has reached the number of output sheets set in the job in Step S190, it is determined that the last image which is based on the job has been formed, and the CPU 314 ends the image formation processing.

Meanwhile, when the count value has not reached the number of output sheets set in the job in Step S190, the CPU 314 advances the process to Step S186. In this manner, until the count value reaches the number of output sheets set in the job, the image forming apparatus 100*a* repeatedly and continuously forms the user image and the tone correction pattern 1104 on the recording material 110.

Further, when the execution of the second tone correction processing is not allowed in Step S182, the CPU 314 executes the first tone correction processing, and hence causes the tone correction pattern 1061 to be formed at a predetermined timing (Step S191). The predetermined timing refers to a timing at which, for example, images corresponding to twenty pages are formed. In Step S191, the CPU 314 transmits the laser output signal of the tone correction pattern 1061 to the engine control unit 102 for controlling the engine unit 1011 so as to cause the tone correction pattern 1061 to be formed.

The CPU 314 causes the image density sensor 117 to measure the tone correction pattern 1061 (Step S192). In Step S192, the engine control unit 102 controls the image density sensor 117 based on the instruction from the CPU 314, and measures the tone correction pattern 1061 on the recording material 110. The output value (voltage) of the image density sensor 117 is converted into the density value. The CPU 314 acquires the density value transmitted from the engine control unit 102.

The CPU 314 generates the γLUT based on the density value acquired in Step S192 (Step S193), and advances the process to Step S190. When the count value has not reached the number of output sheets set in the job in Step S190, the CPU 314 advances the process to Step S191. In this manner, until the count value reaches the number of output sheets set in the job, the image forming apparatus 100*a* forms the tone correction pattern 1061 at every predetermined timing.

The tone correction pattern 1104 is formed in the non-image region 1102 of the recording material 110 (end portion region in a direction orthogonal to the conveying direction in which the recording material 110 is to be conveyed), and hence the formation of the user image is not interrupted for the tone correction. Accordingly, the downtime can be suppressed in the second tone correction processing. The density value acquired in the second tone correction processing is converted into a measurement result of the image for measurement on the intermediate transfer member 106, and the γLUT is generated based on the converted density value. Accordingly, the stability of the image density can be easily achieved regardless of the type of the tone correction.

Further, it is suitable to reacquire the density conversion table depending on various conditions. In each process of transfer and fixing of the image, control parameters are changed depending on environmental conditions (temperature and humidity) in which the image forming apparatus 100*a* is installed. Examples of the control parameters include a value of the transfer voltage and a fixing temperature. As a result, the correspondence between the density (toner adhesion amount) of the image on the recording material 110 and the density (toner adhesion amount) of the image on the intermediate transfer member 106 may change. Accordingly, the CPU 314 executes the processing of generating the density conversion table so as to update the density conversion table, for example, every time images corresponding to 10,000 pages are formed.

Figure 18:
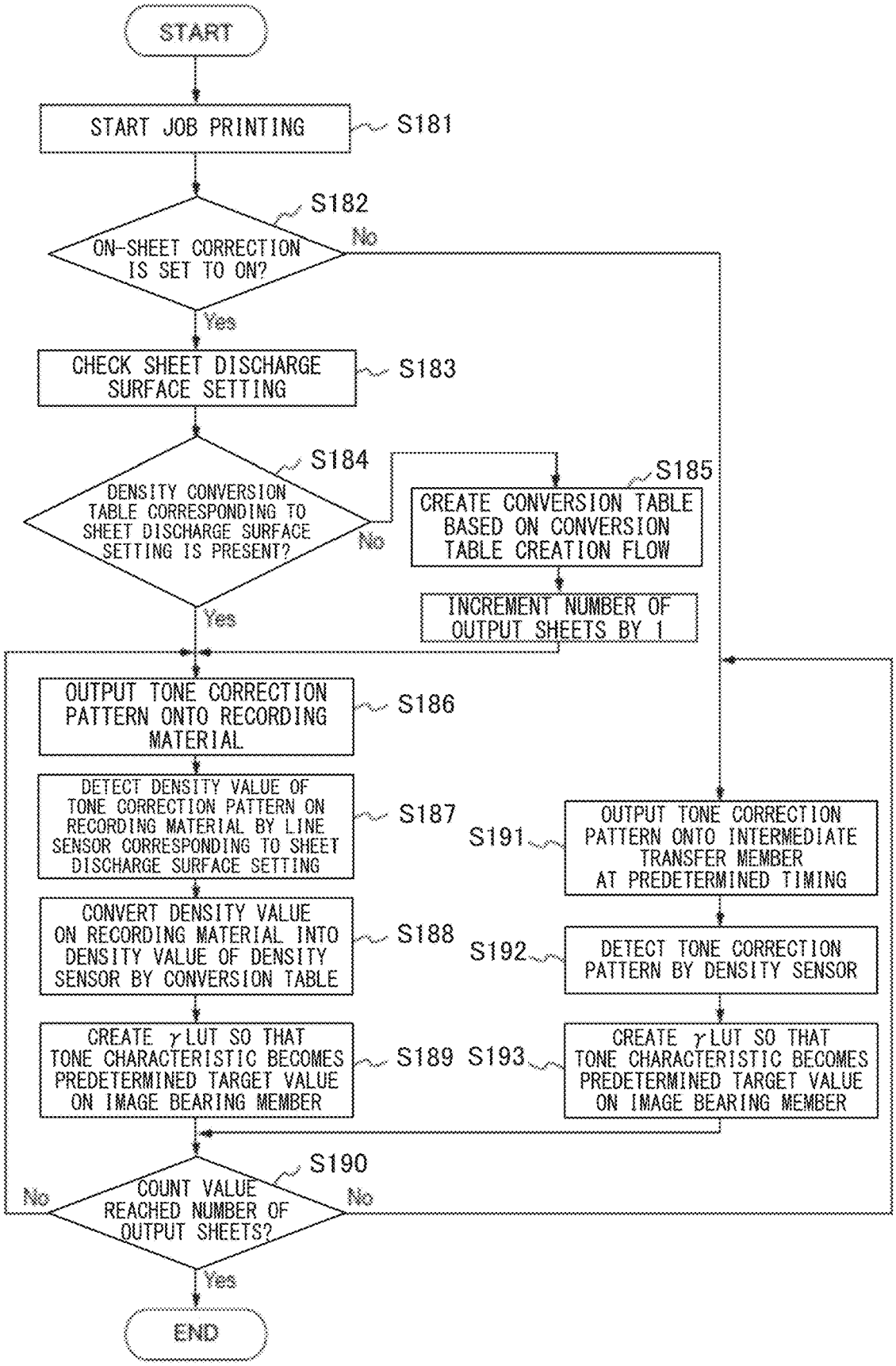
FIG. 18 is a flow chart for illustrating the tone correction processing.

Further, in the image formation processing illustrated in FIG. 18, only one of the first tone correction processing and the second tone correction processing is executed. However, there may be employed a configuration in which the CPU 314 controls whether to execute only the first tone correction processing without executing the second tone correction processing or to execute both of the first tone correction processing and the second tone correction processing. When the execution of the second tone correction processing is allowed in Step S182, the CPU 314 executes both of the first tone correction processing and the second tone correction processing. Meanwhile, when the execution of the second tone correction processing is not allowed in Step S182, the CPU 314 executes only the first tone correction processing. The target density of the first tone correction processing and the target density of the second tone correction processing are the same, and hence even when both of the first tone correction processing and the second tone correction processing are executed, it is possible to suppress the change in image density when the tone correction processing is switched.

Further, according to the image forming apparatus 100*a*, the reading result obtained by the line sensor 138 or 139 is converted based on the density conversion table corresponding to the sheet discharge surface setting, and hence the density of the image to be formed by the image forming apparatus 100*a* can be controlled with high accuracy.

Fourth Embodiment

The image forming apparatus 100*a* of a fourth embodiment of the present disclosure is similar to that of the third embodiment. The image forming apparatus 100*a* of the fourth embodiment creates and selects the density conversion table in accordance with not the sheet discharge surface setting of the recording material 110 but the selection by the user of the line sensor to be used.

The output of the line sensors 138 and 139 is reduced when, for example, toner or paper dust adheres thereon. It is conceivable to employ a configuration in which a usable line sensor is used when toner or paper dust adheres on the line sensors 138 and 139 and thus highly accurate measurement cannot be performed.

At this time, as described in the third embodiment, it is required to create and select the density conversion table corresponding to the line sensor 138 or 139, regardless of the sheet discharge surface setting selected by the user.

When one line sensor cannot be used and the density conversion table for the usable line sensor is effective, the image forming apparatus 100*a* selects the density conversion table corresponding to the usable line sensor. Further, the conversion table corresponding to the usable line sensor may be reacquired when the conversion table is ineffective due to the change in environment of a place at which the image forming apparatus 100*a* is installed or the update of the control parameters of the image forming apparatus 100*a*. In this case, regardless of the sheet discharge surface setting selected by the user, the density conversion table corresponding to the usable line sensor is created.

Figure 21A:
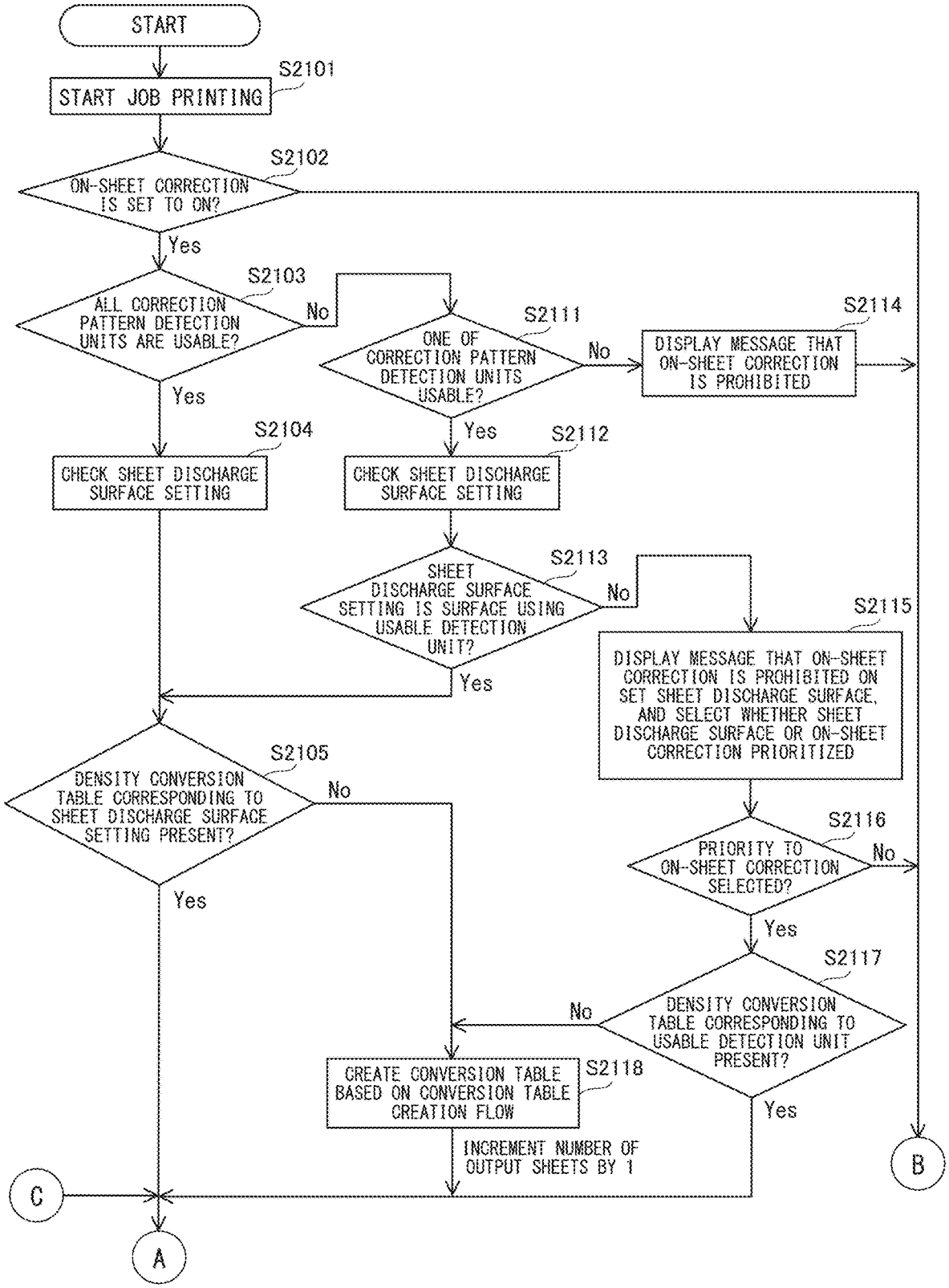
FIG. 21A and FIG. 21B are the flow charts for illustrating the tone correction processing.
Figure 21B:
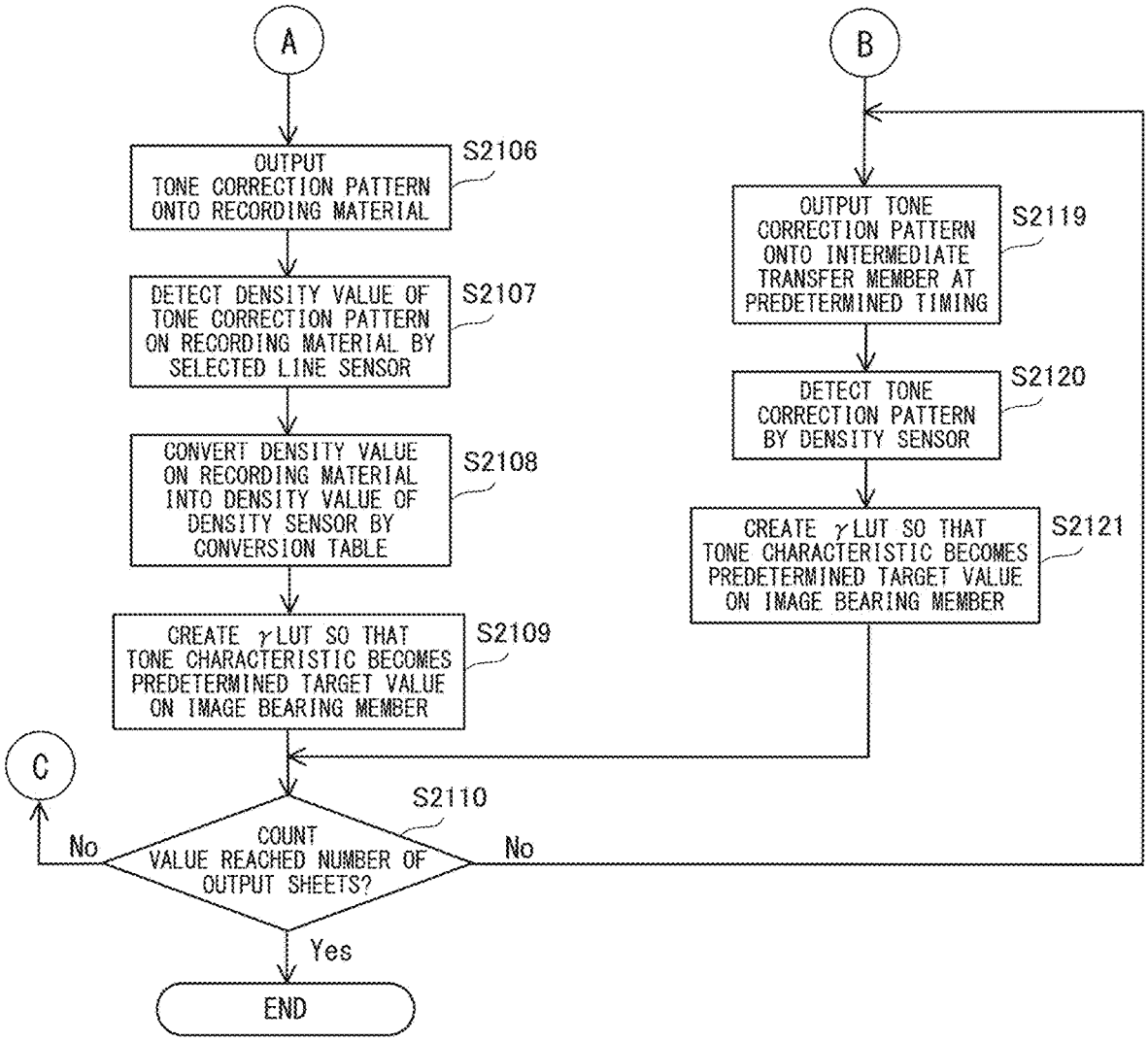

The image formation processing including the tone correction processing is described with reference to the flow charts of FIG. 21A and FIG. 21B. Process steps of Step S2101 and Step S2102 illustrated in FIG. 21A are the same as the process steps of Step S181 and Step S182 illustrated in FIG. 18. Further, process steps of Step S2105 to Step S2110 and Step S2118 illustrated in FIG. 21A and FIG. 21B are the same as the process steps of Step S184 to Step S190 illustrated in FIG. 18. Moreover, process steps of Step S2119 to Step S2121 illustrated in FIG. 21B are the same as the process steps of Step S191 to Step S193 illustrated in FIG. 18. Accordingly, description of the above-mentioned steps is omitted.

When the execution of the second tone correction processing is allowed in Step S2102, the CPU 314 determines whether both of the line sensors 138 and 139 are usable (Step S2103). When both of the line sensors 138 and 139 are in a usable state in Step S2103, the CPU 314 checks the sheet discharge surface setting (Step S2104).

Meanwhile, when both of the line sensors 138 and 139 are unusable in Step S2103, the CPU 314 determines whether any one of the line sensors 138 and 139 is usable (Step S2111). When the line sensor 138 or 139 is in a usable state in Step S2111, the CPU 314 checks the sheet discharge surface setting (Step S2112). Then, the CPU 314 determines whether the line sensor 138 or 139 to be used in the selected sheet discharge surface setting can read the tone correction pattern 1104 (Step S2113). When the line sensor 138 or 139 to be used can read the tone correction pattern 1104 in Step S2113, the CPU 314 advances the process to Step S2105.

Further, when both of the line sensors 138 and 139 are in an unusable state in Step S2111, the CPU 314 causes the operation panel 180 to display a screen for giving a notification that the second tone correction processing (on-sheet correction) cannot be executed (Step S2114). Then, the CPU 314 advances the process to Step S2119 so as to execute the first tone correction processing.

Figure 22:
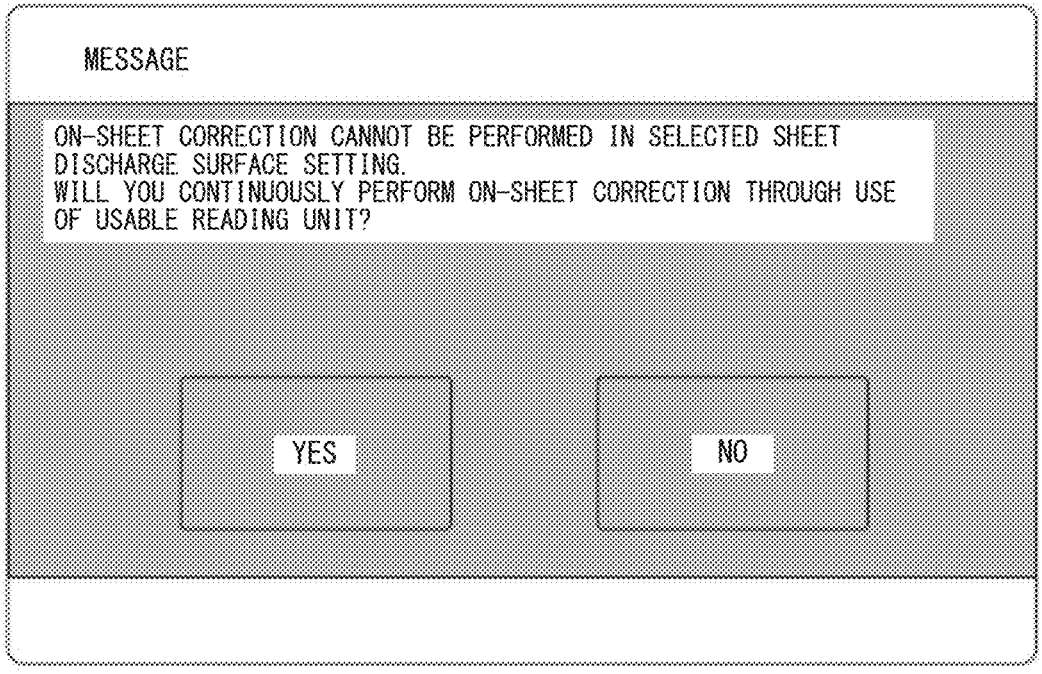
FIG. 22 is a schematic view of a selection screen.

Further, when the tone correction pattern 1104 cannot be read in Step S2113, the CPU 314 causes the operation panel 180 to display a selection screen for selecting whether or not to execute the second tone correction processing (Step S2115). FIG. 22 is a schematic view of the selection screen. The selection screen is a screen on which the user can select whether or not to change the sheet discharge surface setting. The image forming apparatus 100*a* cannot execute the second tone correction processing unless the sheet discharge surface setting is changed. The user can select, on the selection screen, not to execute the second tone correction processing or to change the sheet discharge surface setting.

Next, the CPU 314 acquires the user instruction information indicating the content selected by the user on the selection screen from the operation panel 180, and determines whether priority is given to the second tone correction processing (on-sheet correction) (Step S2116). When no priority is given to the second tone correction processing (on-sheet correction) in Step S2116, that is, when no instruction to change the sheet discharge surface setting is given, the CPU 314 advances the process to Step S2119 so as to execute the first tone correction processing.

Meanwhile, when priority is given to the second tone correction processing (on-sheet correction) in Step S2116, that is, when an instruction to change the sheet discharge surface setting is given, the CPU 314 determines whether or not the density conversion table is stored in the table storage 311 (Step S2117). When no density conversion table 1140 or 1141 for the usable line sensor 138 or 139 is stored in the table storage 311 in Step S2117, the CPU 314 advances the process to Step S2118. In this manner, the processing of generating the density conversion table is executed, and the density conversion table for the usable line sensor 138 or 139 is stored into the table storage 311.

Further, when the density conversion table 1140 or 1141 for the usable line sensor 138 or 139 is stored in the table storage 311 in Step S2117, the CPU 314 advances the process to Step S2106.

When the image forming apparatus 100*a* cannot compensate for the reading accuracy of one of the line sensors 138 and 139, the image forming apparatus 100*a* gives a notification that the second tone correction processing cannot be executed in the sheet discharge surface setting selected by the user. Further, the image forming apparatus 100*a* allows the user to select whether to carry out the second tone correction processing through use of the other usable line sensor or to carry out the image formation processing while giving priority to the sheet discharge surface setting in the following operation. Thus, the image forming apparatus 100*a* can perform the operation depending on the situation. As described above, according to the image forming apparatus 100*a* described in the fourth embodiment, whether to give priority to the sheet discharge surface setting or to give priority to the second tone correction processing can be displayed so as to be selectable by the user.

Fifth Embodiment

In the image forming apparatus 100*a* described in each of the third and fourth embodiments, only the case in which the user image and the tone correction pattern 1104 are formed on one surface of the recording material 110 has been described. That is, description has been made only for a job for causing the image forming apparatus 100*a* to form an image on one surface of the recording material 100 (hereinafter referred to as "simplex printing job"). However, the image forming apparatus 100*a* can also form images on both surfaces of the recording material 110. In view of the above, in the following, description is given of the tone correction processing at the time when images are formed based on a job for causing the image forming apparatus 100*a* to form images on both surfaces of the recording material 110 (hereinafter referred to as "duplex printing job").

In this case, in the simplex printing job, the recording material 110 passes through the fixing device 150 only once, while, in the duplex printing job, the recording material 110 passes through the fixing device 150 twice. That is, the influence of heat from the fixing device 150 is different between the simplex printing job and the duplex printing job. Accordingly, the densities of the tone correction pattern 1104 and the user image may also be different between the simplex printing job and the duplex printing job. In view of the above, the image forming apparatus 100*a* of a fifth embodiment of the present disclosure has a feature in that, in order to control the density of the output image with high accuracy in both of the simplex printing job and the duplex printing job, the image forming apparatus 100*a* includes a density conversion table for simplex printing and a density conversion table for duplex printing.

Processing of generating the density conversion table for duplex printing is carried out when a corresponding recording material 110 is output by the image forming apparatus 100*a* for the first time. First, the engine control unit 102 causes the engine unit 1011 to form the tone correction pattern 1061 on the intermediate transfer member 106 based on the instruction from the CPU 314. Next, the engine control unit 102 causes the image density sensor 117 to measure the tone correction pattern 1061 on the intermediate transfer member 106 based on the instruction from the CPU 314. In this manner, the CPU 314 acquires a density value B of the tone correction pattern 1061. After that, the engine control unit 102 causes the engine unit 1011 to form the tone correction pattern 1104 on a first surface of the recording material 110 based on the instruction from the CPU 314. When the duplex printing job is executed, the conveyance mechanism 130 conveys the recording material 110 to the duplex printing conveyance path. In this manner, the first surface of the recording material 110 conveyed through the conveyance path 201 is read by the line sensor 139. The engine control unit 102 causes the line sensor 139 to read the tone correction pattern 1104 on the recording material 110 based on the instruction from the CPU 314. The CPU 314 acquires a density value A of the tone correction pattern 1104. The CPU 314 generates a density conversion table T3 for duplex printing based on the density value A and the density value B. When the duplex printing job is executed, the CPU 314 converts a reading result of the tone correction pattern 1104 into a density value based on the density conversion table T3 for duplex printing, and generates the γLUT based on the converted density value.

<Tone Correction Control>

Next, the image formation processing including the tone correction processing is described with reference to the flow chart of FIG. 23. When the image forming apparatus 100*a* receives the instruction to execute the image formation processing based on a job, the CPU 314 reads out a program from the program ROM 304 and loads the program onto the RAM 310, to thereby execute each step of FIG. 23.

Figure 23:
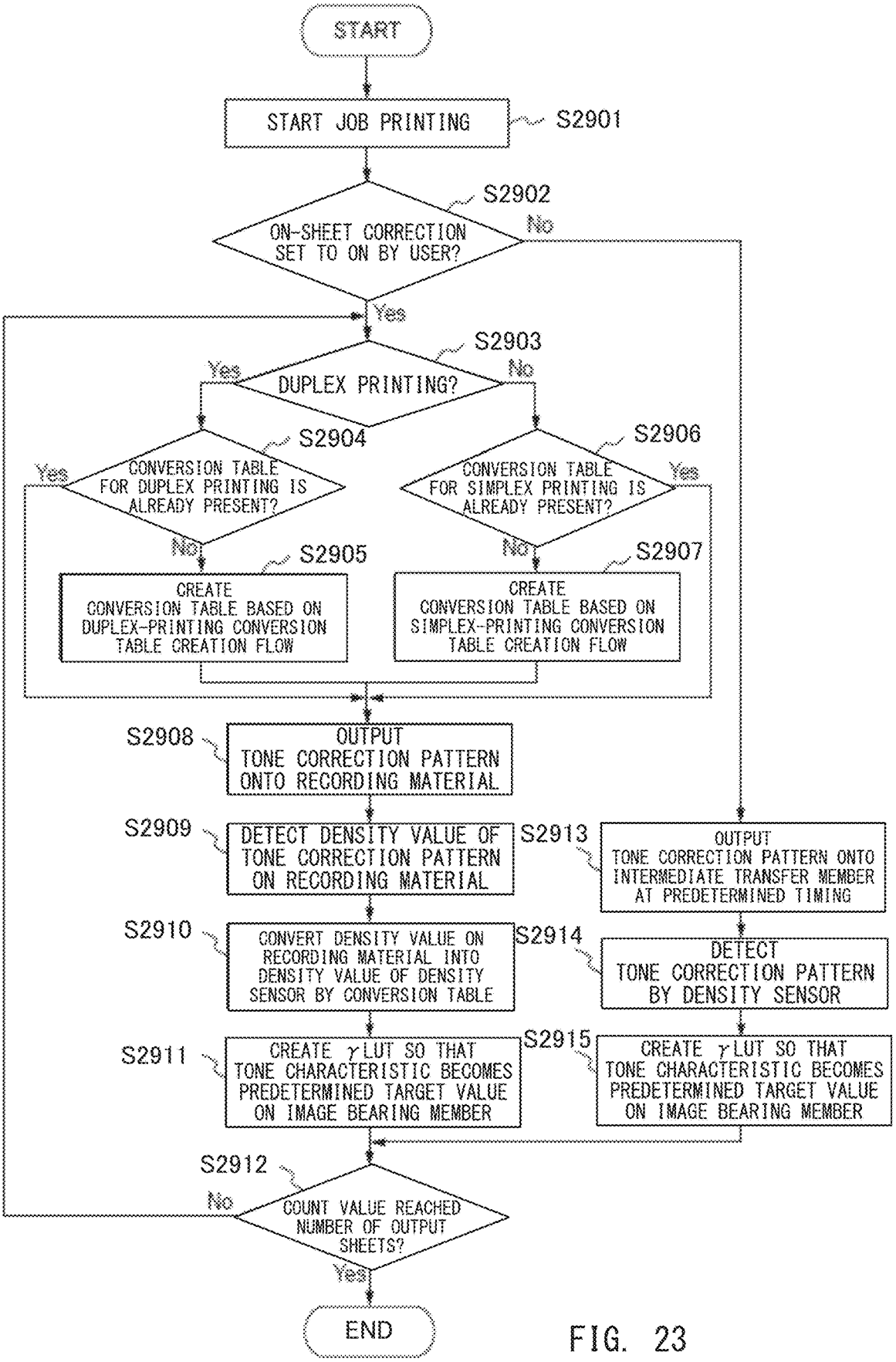
FIG. 23 is a flow chart for illustrating the tone correction processing.

Process steps of Step S2901 and Step S2902 illustrated in FIG. 23 are the same as the process steps of Step S181 and Step S182 illustrated in FIG. 18. Further, process steps of Step S2908 to Step S2915 illustrated in FIG. 23 are the same as the process steps of Step S186 to Step S193 illustrated in FIG. 18. Accordingly, description of the above-mentioned steps is omitted.

When the execution of the second tone correction processing is allowed in Step S2902, the CPU 314 determines whether or not the job is the duplex printing job (Step S2903). The user selects the simplex printing job or the duplex printing job in the print setting at the time of transmitting the job to the image forming apparatus 100*a*. The CPU 314 acquires the information indicating whether the job is the simplex printing job or the duplex printing job so that the CPU 314 can determine whether the job is the duplex printing job or the simplex printing job.

When it is determined that the job is the duplex printing job in Step S2903, the CPU 314 determines whether or not the density conversion table T3 for duplex printing is stored in the table storage 311 (Step S2904). When the density conversion table T3 for duplex printing is stored in the table storage 311 in Step S2904, the CPU 314 advances the process to Step S2908. In this manner, the engine unit 1011 forms the user image and the tone correction pattern 1104 on the recording material 110 based on the duplex printing job.

Meanwhile, when no density conversion table T3 for duplex printing is stored in the table storage 311 in Step S2904, the CPU 314 executes the processing of generating the density conversion table T3 for duplex printing described above. In this manner, the density conversion table T3 for duplex printing is stored into the table storage 311. Then, the CPU 314 advances the process to Step S2908.

Further, when it is determined that the job is the simplex printing job in Step S2903, the CPU 314 determines whether a density conversion table (density conversion table for simplex printing) corresponding to the sheet discharge surface setting described in the third embodiment is stored in the table storage 311 (Step S2906). When the density conversion table for simplex printing is stored in the table storage 311 in Step S2906, the CPU 314 advances the process to Step S2908. In this manner, the engine unit 1011 forms the user image and the tone correction pattern 1104 on the recording material 110 based on the simplex printing job.

Meanwhile, when no density conversion table for simplex printing is stored in the table storage 311 in Step S2906, the CPU 314 executes the processing of generating the density conversion table illustrated in FIG. 17. In this manner, the density conversion table for simplex printing is stored into the table storage 311. Then, the CPU 314 advances the process to Step S2908.

According to the image forming apparatus 100*a* described in the fifth embodiment, both of the density conversion table for simplex printing and the density conversion table for duplex printing are generated, and hence the image density can be controlled with high accuracy in consideration of the density variation to be caused by the influence of heat from the fixing device 150.

Further, in the image forming apparatus 100*a* described in the fifth embodiment, the density value converted based on the density conversion table for simplex printing and the density value converted based on the density conversion table for duplex printing are the same. In this manner, even when the image is formed based on a job in which the simplex printing job and the duplex printing job are mixed, it is possible to suppress variations of the image density through use of the density conversion table for simplex printing and the density conversion table for duplex printing.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-013701, filed Jan. 29, 2021, and Japanese Patent Application No. 2021-016511, filed Feb. 4, 2021, which are hereby incorporated by reference herein in their entirety.

What is claimed is:

1. An image forming apparatus comprising:

an image forming unit configured to form an image on a sheet based on an image density condition for controlling a density of the image, the image forming unit having an image bearing member on which the image is to be formed, a transfer unit configured to transfer the image from the image bearing member onto the sheet, and a fixing unit configured to fix the image to the sheet;

a tray on which the sheet is to be stacked;

a conveyance roller configured to convey the sheet from the fixing unit to the tray;

a detector configured to detect a pattern image on the image bearing member;

a reading unit configured to read a pattern image on the sheet, the reading unit being arranged downstream from the fixing unit in a conveyance direction in which the sheet is conveyed by the conveyance roller; and a controller configured to:

generate the image density condition based on a detection result of a pattern image on the image bearing member detected by the detector, the pattern image on the image bearing member being formed by the image forming unit, convert a reading result of a pattern image on the sheet read by the reading unit based on a conversion condition for converting a reading result by the reading unit to a detection result by the detector, the pattern image on the sheet being formed by the image forming unit, and generate the image density condition based on a converted reading result of the pattern image.

2. The image forming apparatus according to claim 1, wherein the image forming unit includes an image processor configured to convert image data based on the image density condition, and wherein the image forming unit forms the image based on the image data converted by the image processor.

3. The image forming apparatus according to claim 2, wherein the image density condition comprises a tone correction table.

4. The image forming apparatus according to claim 1, wherein the reading unit includes a first image sensor configured to read a pattern image formed on a first surface of the sheet, and a second image sensor configured to read a pattern image formed on a second surface different from the first surface of the sheet.

5. The image forming apparatus according to claim 4, wherein the first image sensor and the second image sensor are line sensors, respectively.

6. The image forming apparatus according to claim 4, wherein the conversion condition includes a conversion condition for the first image sensor and a conversion condition for the second image sensor.

7. The image forming apparatus according to claim 4, wherein the controller is configured to acquire a sheet discharge surface setting, and wherein the controller is configured to select an image sensor to read the pattern image on the sheet based on the sheet discharge surface setting.

8. The image forming apparatus according to claim 1, wherein the conversion condition differs for each type of the sheet.

9. The image forming apparatus according to claim 1, wherein the pattern image on the sheet is formed in the outer edge region of the sheet, the outer edge region being intended to be cut.

10. The image forming apparatus according to claim 1, wherein the pattern image includes test images having different tones.

11. An image forming apparatus comprising:

an image forming unit configured to form an image on a sheet based on an image density condition for controlling a density of the image, the image forming unit having an image bearing member on which the image is to be formed, a transfer unit configured to transfer the image from the image bearing member onto the sheet, and a fixing unit configured to fix the image to the sheet;

a tray on which the sheet is to be stacked;

a conveyance roller configured to convey the sheet from the fixing unit to the tray;

a detector configured to detect a pattern image on the image bearing member;

a reading unit configured to read a pattern image on the sheet, the reading unit being arranged downstream from the fixing unit in a conveyance direction in which the sheet is conveyed by the conveyance roller; and a controller configured to:

generate the image density condition based on a detection result of a pattern image on the image bearing member detected by the detector, the pattern image on the image bearing member being formed by the image forming unit, determine, based on a detection result of a pattern image detected by the detector and a reading result of a pattern image read by the reading unit, a relationship between the detection result and the reading result, and generate the image density condition based on the relationship and a reading result by the reading unit of a pattern image that is formed in a density adjustment sequence using the reading unit.

12. The image forming apparatus according to claim 11, wherein the image forming unit includes an image processor configured to convert image data based on, the image density condition, and wherein the image forming unit forms the image based on the image data converted by the image processor.

13. The image forming apparatus according to claim 12, wherein the image density condition comprises a tone correction table.

14. The image forming apparatus according to claim 11, wherein the reading unit includes a first image sensor configured to read a pattern image formed on a first surface of the sheet, and a second image sensor configured to read a pattern image formed on a second surface different from the first surface of the sheet.

15. The image forming apparatus according to claim 14, wherein the first image sensor and the second image sensor are line sensors, respectively.

16. The image forming apparatus according to claim 14, wherein the controller is configured to acquire a sheet discharge surface setting, and wherein the controller is configured to select an image sensor to read the pattern image on the sheet based on the sheet discharge surface setting.

17. The image forming apparatus according to claim 11, wherein the pattern image on the sheet is formed in an outer edge region of the sheet, the outer edge region being intended to be cut.

18. The image forming apparatus according to claim 11, wherein the pattern image includes test images having different tones.

* * * * *